US006609461B2

(12) United States Patent
Horii et al.

(10) Patent No.: US 6,609,461 B2
(45) Date of Patent: Aug. 26, 2003

(54) PRINTER DIAGNOSIS DEVICE, PRINTER DIAGNOSIS METHOD, AND COMPUTER-READABLE PROGRAM STORAGE MEDIUM CONTAINING PROGRAM HAVING PRINTER DIAGNOSIS FUNCTION

(75) Inventors: Shinichi Horii, Kanagawa (JP); Shigeyoshi Hirashima, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/896,515

(22) Filed: Jun. 29, 2001

(65) Prior Publication Data

US 2002/0043173 A1 Apr. 18, 2002

(30) Foreign Application Priority Data

Jun. 29, 2000 (JP) ..... P2000-201470
Jun. 29, 2000 (JP) ..... P2000-201471

(51) Int. Cl.[7] ..... B41F 1/54
(52) U.S. Cl. ..... 101/484; 347/7; 347/19
(58) Field of Search ..... 101/484, 483; 399/24–29; 347/84–86, 7, 19, 23

(56) References Cited

U.S. PATENT DOCUMENTS 5,068,806 A * 11/1991 Gatten ..... 358/1.14
5,132,711 A * 7/1992 Shinada et al. ..... 347/6
5,459,556 A * 10/1995 Acquaviva et al. ..... 399/58
5,797,061 A 8/1998 Overall et al. ..... 399/27
6,223,131 B1 * 4/2001 Kanaya et al. ..... 702/55
6,302,503 B1 * 10/2001 Seu ..... 347/7
6,312,083 B1 * 11/2001 Moore ..... 347/19

FOREIGN PATENT DOCUMENTS

DE 196 30 604 A1 2/1997
EP 63104870 10/1988
EP 0 873 873 A2 10/1998
EP 0 917 096 A2 5/1999

* cited by examiner

*Primary Examiner*—Stephen R. Funk
*Assistant Examiner*—Minh Chau
(74) *Attorney, Agent, or Firm*—Bell, Boyd & Lloyd, LLC

(57) ABSTRACT

A self-diagnosis device includes a diagnosing unit for diagnosing the condition of a printer which prints on record sheets and a displaying unit for displaying a diagnosis result based on the condition of the printer.

21 Claims, 22 Drawing Sheets

| | PRINT SIZE | IMAGE TYPE | NUMBER OF SHEETS PRINTING CAN BE PERFORMED FOR EACH COLOR | | | | FINAL NUMBER OF SHEETS PRINTING CAN BE PERFORMED |
|---|---|---|---|---|---|---|---|
| | | | YELLOW | MAGENTA | CYAN | BLACK | |
| SAMPLE 1 | A4 | PORTRAIT | 1851 | 1323 | 434 | 4000 | 434 |
| SAMPLE 2 | A4 | LANDSCAPE 1 | 2857 | 1666 | 645 | 4285 | 645 |
| SAMPLE 3 | A4 | LANDSCAPE 2 | 1538 | 2142 | 1428 | 2400 | 1428 |
| SAMPLE 4 | A4 | DOCUMENT | — | — | 0 | 5000 | 5000 |
| SAMPLE 5 | POSTCARD | ADDRESS OF NEW YEAR'S CARD | — | — | 0 | 12857 | 12857 |
| SAMPLE 6 | POSTCARD | NEW YEAR'S CARD 1 | 8333 | 2903 | 1428 | 18000 | 1428 |
| SAMPLE 7 | POSTCARD | NEW YEAR'S CARD 2 | 4545 | 6666 | 4000 | 10588 | 4000 |

154

| DETECTION DATE | | 2000/01/01 11:21 | 2000/01/15 11:35 | 2000/02/05 09:21 | 2000/03/22 15:00 |
|---|---|---|---|---|---|
| AMOUNT OF INK REMAINING [cc] | Y | 15 | 14 | 12 | 10 |
| | M | 15 | 14 | 11 | 9 |
| | C | 15 | 13 | 11 | 4 |
| | B | 30 | 25 | 22 | 18 |

| | EXPIRATION PERIOD FOR EACH COLOR | TOTAL DETER-MINATION | DETER-MINATION DATE |
|---|---|---|---|
| YELLOW | 2000/06/05 | 2000/04/21 | 2000/03/22 |
| MAGENTA | 2000/05/12 | | |
| CYAN | 2000/04/21 | | |
| BLACK | 2000/07/30 | | |

FIG. 13

| | PRINT SIZE | IMAGE TYPE | AMOUNT OF REQUIRED INK | | | |
|---|---|---|---|---|---|---|
| | | | $Y_0$ | $M_0$ | $C_0$ | $B_0$ |
| SAMPLE 1 | A4 | PORTRAIT | 5.4 | 6.8 | 9.2 | 4.5 |
| SAMPLE 2 | A4 | LANDSCAPE 1 | 3.5 | 5.4 | 6.2 | 4.2 |
| SAMPLE 3 | A4 | LANDSCAPE 2 | 6.5 | 4.2 | 2.8 | 7.5 |
| SAMPLE 4 | A4 | DOCUMENT | 0 | 0 | 0 | 3.6 |
| SAMPLE 5 | POSTCARD | ADDRESS OF NEW YEAR'S CARD | 0 | 0 | 0 | 1.4 |
| SAMPLE 6 | POSTCARD | NEW YEAR'S CARD 1 | 1.2 | 3.1 | 2.8 | 1.0 |
| SAMPLE 7 | POSTCARD | NEW YEAR'S CARD 2 | 2.2 | 1.5 | 1.0 | 1.7 |

FIG. 14

| DETECTION DATE | | 2000/03/22 15:00 |
|---|---|---|
| AMOUNT OF INK REMAINING [cc] | Y | 10 |
| | M | 9 |
| | C | 4 |
| | B | 18 |

FIG. 15

| | PRINT SIZE | IMAGE TYPE | NUMBER OF SHEETS PRINTING CAN BE PERFORMED FOR EACH COLOR | | | | FINAL NUMBER OF SHEETS PRINTING CAN BE PERFORMED |
|---|---|---|---|---|---|---|---|
| | | | YELLOW | MAGENTA | CYAN | BLACK | |
| SAMPLE 1 | A4 | PORTRAIT | 1851 | 1323 | 434 | 4000 | 434 |
| SAMPLE 2 | A4 | LANDSCAPE 1 | 2857 | 1666 | 645 | 4285 | 645 |
| SAMPLE 3 | A4 | LANDSCAPE 2 | 1538 | 2142 | 1428 | 2400 | 1428 |
| SAMPLE 4 | A4 | DOCUMENT | — | — | 0 | 5000 | 5000 |
| SAMPLE 5 | POSTCARD | ADDRESS OF NEW YEAR'S CARD | — | — | 0 | 12857 | 12857 |
| SAMPLE 6 | POSTCARD | NEW YEAR'S CARD 1 | 8333 | 2903 | 1428 | 18000 | 1428 |
| SAMPLE 7 | POSTCARD | NEW YEAR'S CARD 2 | 4545 | 6666 | 4000 | 10588 | 4000 |

FIG. 16

76

WHEN PRINT SAMPLES ARE PRINTED, NUMBER OF SHEETS PRINTING CAN BE PERFORMED IS SHOWN.

DETECTION DATE : 2000/03/22

| SAMPLE NAME | NUMBER OF SHEETS PRINTING CAN BE PERFORMED |
|---|---|
| SAMPLE 1 | 434 |
| SAMPLE 2 | 645 |
| SAMPLE 3 | 1428 |
| SAMPLE 4 | 5000 |
| SAMPLE 5 | 12857 |
| SAMPLE 6 | 1428 |
| SAMPLE 7 | 4000 |

FIG. 21

154

| DETECTION DATE | | 2000/01/01 11:21 | 2000/01/15 11:35 | 2000/02/05 09:21 | 2000/03/22 15:00 |
|---|---|---|---|---|---|
| AMOUNT OF INK REMAINING [cc] | Y | 15 | 14 | 12 | 10 |
| | M | 15 | 14 | 11 | 9 |
| | C | 15 | 13 | 11 | 4 |
| | B | 30 | 25 | 22 | 18 |

FIG. 22

| | EXPIRATION PERIOD FOR EACH COLOR | TOTAL DETER-MINATION | DETER-MINATION DATE |
|---|---|---|---|
| YELLOW | 2000/06/05 | 2000/04/21 | 2000/03/22 |
| MAGENTA | 2000/05/12 | | |
| CYAN | 2000/04/21 | | |
| BLACK | 2000/07/30 | | |

FIG. 25

| | PRINT SIZE | IMAGE TYPE | AMOUNT OF REQUIRED INK | | | |
|---|---|---|---|---|---|---|
| | | | $Y_0$ | $M_0$ | $C_0$ | $B_0$ |
| SAMPLE 1 | A4 | PORTRAIT | 5.4 | 6.8 | 9.2 | 4.5 |
| SAMPLE 2 | A4 | LANDSCAPE 1 | 3.5 | 5.4 | 6.2 | 4.2 |
| SAMPLE 3 | A4 | LANDSCAPE 2 | 6.5 | 4.2 | 2.8 | 7.5 |
| SAMPLE 4 | A4 | DOCUMENT | 0 | 0 | 0 | 3.6 |
| SAMPLE 5 | POSTCARD | ADDRESS OF NEW YEAR'S CARD | 0 | 0 | 0 | 1.4 |
| SAMPLE 6 | POSTCARD | NEW YEAR'S CARD 1 | 1.2 | 3.1 | 2.8 | 1.0 |
| SAMPLE 7 | POSTCARD | NEW YEAR'S CARD 2 | 2.2 | 1.5 | 1.0 | 1.7 |

FIG. 26

| DETECTION DATE | | 2000/03/22 15:00 |
|---|---|---|
| AMOUNT OF INK REMAINING [cc] | Y | 10 |
| | M | 9 |
| | C | 4 |
| | B | 18 |

FIG. 27

| | PRINT SIZE | IMAGE TYPE | NUMBER OF SHEETS PRINTING CAN BE PERFORMED FOR EACH COLOR | | | | FINAL NUMBER OF SHEETS PRINTING CAN BE PERFORMED |
|---|---|---|---|---|---|---|---|
| | | | YELLOW | MAGENTA | CYAN | BLACK | |
| SAMPLE 1 | A4 | PORTRAIT | 1851 | 1323 | 434 | 4000 | 434 |
| SAMPLE 2 | A4 | LANDSCAPE 1 | 2857 | 1666 | 645 | 4285 | 645 |
| SAMPLE 3 | A4 | LANDSCAPE 2 | 1538 | 2142 | 1428 | 2400 | 1428 |
| SAMPLE 4 | A4 | DOCUMENT | — | — | 0 | 5000 | 5000 |
| SAMPLE 5 | POSTCARD | ADDRESS OF NEW YEAR'S CARD | — | — | 0 | 12857 | 12857 |
| SAMPLE 6 | POSTCARD | NEW YEAR'S CARD 1 | 8333 | 2903 | 1428 | 18000 | 1428 |
| SAMPLE 7 | POSTCARD | NEW YEAR'S CARD 2 | 4545 | 6666 | 4000 | 10588 | 4000 |

FIG. 28

76

WHEN PRINT SAMPLES ARE PRINTED, NUMBER OF SHEETS PRINTING CAN BE PERFORMED IS SHOWN.

DETECTION DATE : 2000/03/22

| SAMPLE NAME | NUMBER OF SHEETS PRINTING CAN BE PERFORMED |
|---|---|
| SAMPLE 1 | 434 |
| SAMPLE 2 | 645 |
| SAMPLE 3 | 1428 |
| SAMPLE 4 | 5000 |
| SAMPLE 5 | 12857 |
| SAMPLE 6 | 1428 |
| SAMPLE 7 | 4000 |

PRINTER DIAGNOSIS DEVICE, PRINTER DIAGNOSIS METHOD, AND COMPUTER-READABLE PROGRAM STORAGE MEDIUM CONTAINING PROGRAM HAVING PRINTER DIAGNOSIS FUNCTION

BACKGROUND OF THE INVENTION

1. Field of the Invention

The present invention relates to a printer self-diagnosis device and a printer self-diagnosis method for self-diagnosing the condition of a printer, and relates to a computer-readable program storage medium storing a program having a printer self-diagnosis function. In addition, the present invention relates to a printer remote-diagnosis device and a printer remote-diagnosis method for remotely diagnosing the condition of a printer via a communication medium, and relates to a computer-readable program storage medium storing a program having a remote-diagnosis function.

2. Description of the Related Art

Because of recent advancements in information technologies, computers are being more widely used in offices and homes. Printers connected to the computers are now also widely used. Since the printers print characters, images, and the like by printing ink on record sheets, when the printers print, the amount of ink remaining decreases. In, for example, inkjet printers, various methods using mechanics, optics, electric sensors and the like have been conventionally proposed for detecting the amount of ink remaining. To be specific, in conventional methods for detecting the amount of ink remaining, the amount of ink remaining is indicated as a percentage of the total volume of an ink tank, or an alarm notifies a user when there is a shortage of the amount of ink remaining.

As disclosed in Japanese Unexamined Patent Application Publication No. 10-271261, the result of the diagnosis on the conditions of such a printer must be stored in the printer periodically. That is, in order to store the diagnosis result, a log file must be created on a hard disk or the like in a computer which is connected to the printer.

However, the following problems arise in the foregoing conventional example.

The first problem is that the above-described method for indicating the amount of ink remaining does not show a user the diagnosis result of the amount of ink remaining and the like in an easy-to-understand manner because the length of time the ink can be used based on the user's previous usage-pattern of the printer is not clearly indicated. That is, conventional printers do not show, in an easy-to-understand manner, how many more days the printer can print with the ink available if the printer continues to be used at the current printing pace, or how many more sheets of a predetermined images having a predetermined print size can be printed. Furthermore, since the frequency of use of the printer and colors to be used when printing is performed depends on the user, the amount of ink remaining is not indicated in such a manner which takes the usage-pattern of each user into account.

A second problem is that the method for storing the diagnosis result of the printer condition in the computer as the log file, as disclosed in Japanese Unexamined Patent Application Publication No. 10-271261, causes a disadvantage in that the size of the log file increases in proportion to the number of times the printer diagnosis is sampled. Since the size of the log file increases in this manner, the storage capacity of the computer must be increased. In addition, the load on the computer that processes such a large log file is heavy.

SUMMARY OF THE INVENTION

Accordingly, in order to solve the above first problem, it is a first object of the present invention to provide a self-diagnosis device, a self-diagnosis method, and a computer-readable program storage medium containing a program having a self-diagnosis function capable of diagnosing specifically the conditions of a printer in accordance with the user's usage-pattern of the printer.

Further, in order to solve the above second problem, it is a second object of the present invention to provide a remote-diagnosis device, a remote-diagnosis method, and computer readable program storage medium containing a program having a remote-diagnosis function capable of remotely diagnosing the conditions of a printer specifically in accordance with the user's usage-pattern of the printer while lightening the load on the printer.

To achieve the first object of the present invention, according to a first aspect of the present invention, there is provided a self-diagnosis device including a diagnosing unit for diagnosing the condition of a printer which prints on record sheets and a displaying unit for displaying a diagnosis result based on the condition of the printer.

This enables the printer for printing record sheets to self-diagnose its condition and to display a diagnosis result. That is, without the help of an external function, the printer can self-diagnose the condition thereof and can notify the diagnosis result to a user or the like.

The diagnosis unit may detect the amount of ink remaining in the printer and estimate, based on the depletion trend of the amount of ink remaining, when the ink will run out.

Because of this, without the help of the external function, the printer can diagnose the length of time the printer can continue to print with the ink available and can display, based on the diagnosis result, when the ink will run short. This enables the amount of ink remaining to be maintained more than a predetermined amount.

The diagnosis unit may detect the amount of ink remaining in the printer and compute how many sheets of a sample image can be printed with the amount of the ink remaining.

Because of this, without the help of the external function, the printer can diagnose the length of time the printer can continue to print with the ink available and can display, as a diagnosis result, the number of sheets of a predetermined sample image can be printed. This enables the user to recognize the amount of the ink remaining in a concrete manner.

Furthermore, in order to achieve the first object, according to a second aspect of the present invention, a self-diagnosis method includes the steps of diagnosing the condition of a printer which prints on record sheets and displaying a diagnosis result based on the condition of the printer.

This enables the printer for printing record sheets to self-diagnose its condition and to display a diagnosis result. That is, without the help of an external function, the printer can self-diagnose the condition thereof and can provide the diagnosis result to a user or the like.

Alternatively, in the diagnosing step, the amount of ink remaining in the printer is detected and the time at which the ink will run out is estimated based on the depletion trend of the amount of ink remaining.

Because of this, without the help of the external function, the printer can diagnose the length of time the printer can continue to print with the ink available and can display, based on the diagnosis result, when the ink will run out. This enables the amount of ink remaining to be maintained more than a predetermined amount.

Alternatively, in the diagnosis step, the amount of ink remaining in the printer is detected and how many sheets of a sample image can be printed with the amount of ink remaining is computed.

Because of this, without the help of the external function, the printer can diagnose the length of time the printer can continue to print with the ink available and can display, as a diagnosis result, the number of sheets of a predetermined sample image can be printed. This enables the user to recognize the amount of the ink remaining in a concrete manner.

In addition, in order to achieve the first object, according to a third aspect of the present invention, a computer-readable program storage medium for storing a program having a self-diagnosis function includes the steps of diagnosing the condition of a printer which prints on record sheets and displaying a diagnosis result based on the condition of the printer.

Alternatively, in the diagnosing step, the amount of ink remaining in the printer is detected and the time at which the ink runs out is estimated based on the depletion trend of the amount of ink remaining.

Alternatively, in the diagnosis step, the amount of ink remaining in the printer is detected and how many sheets of a sample image can be printed with the amount of ink remaining is computed.

In order to achieve the second object, according to a fourth aspect of the present invention, a remote-diagnosis device includes a control unit for controlling the operation of a printer which prints on record sheets, a detecting unit for detecting the condition of the printer, a diagnosing unit for remotely diagnosing the condition of the printer detected by the detecting unit via a communication medium for transmitting the condition diagnosis result of the printer to the control unit and a displaying unit for displaying the condition diagnosis result.

This eliminates the necessity of the printer holding the diagnosis result of the printer condition for itself. Since the printer does not have to self-diagnose the detected condition, the load on the printer is lightened. In addition, since the high processing power is not required for this printer, the printer can be inexpensive.

Alternatively, the diagnosis unit detects the amount of ink remaining in the printer and estimates, based on the depletion trend of the amount of the ink remaining, when the ink will run out.

Accordingly, the use of the external function causes the printer to remotely diagnose the length of time the printer can continue to print with the ink available and to display, based on the diagnosis result, when the ink will run out. This enables the amount of ink remaining to be maintained more than a predetermined amount.

Alternatively, the diagnosis unit detects the amount of ink remaining in the printer and computes how many sheets of a sample image can be printed with the amount of ink remaining.

Because of this, with the help of the external function, the length of time the printer can continue to print with the ink available can be remotely diagnosed and the number of sheets of a predetermined sample image can be printed can be displayed as a diagnosis result. This enables the user to recognize the amount of ink remaining in a concrete manner.

The printer may include a storing unit for storing at least part of the condition of the printer detected by the detecting unit and a transmitting unit for transmitting the at least part of the condition of the printer via the communication medium when data communication is enabled.

Since this eliminates the necessity of transmission of the detected condition at one time, the amount of data on the condition of the printer transmitted at one time can be decreased.

The communication medium may perform data communication using the Internet.

In order to achieve the second object, according to a fifth aspect of the present invention, a remote-diagnosis method includes the steps of detecting the condition of a printer which prints on record sheets, remotely diagnosing the condition of the printer detected in the detecting step via a communication medium and then transmitting, via the communication medium, a diagnosis result of the condition of the printer to a control unit for controlling the operation of the printer, and displaying the diagnosis result.

Alternatively, in the diagnosing step, the amount of ink remaining in the printer is detected and the time at which the ink will run out is estimated based on the depletion trend of the amount of ink remaining.

Alternatively, in the diagnosis step, the amount of ink remaining in the printer is detected and how many sheets of a sample image can be printed with the amount of ink remaining is computed.

Alternatively, the printer stores at least part of the condition of the printer detected in the detecting step and transmits the at least part of the condition of the printer, via the communication medium, when data communication is enabled.

The communication medium may perform data communication using the Internet.

In order to achieve the second object, according to a sixth aspect of the present invention, a computer-readable program storage medium storing a program having a remote-diagnosis function includes the steps of detecting the condition of a printer which prints on record sheets, remotely diagnosing the condition of the printer detected in the detecting step via a communication medium and then transmitting, via the communication medium, a condition diagnosis result of the printer to a control unit for controlling the operation of the printer to a control unit for controlling the operation of the printer, and displaying the diagnosis result.

Alternatively, in the diagnosing step, the amount of ink remaining in the printer is detected and the time at which the ink will run out is estimated based on the depletion trend of the amount of ink remaining.

Alternatively, in the diagnosis step, the amount of ink remaining in the printer is detected and how many sheets of a sample image can e printed with the amount of ink remaining is computed.

Alternatively, the printer stores at least part of the condition of the printer detected in the detecting step and transmits the least part of the condition of the printer, via the communication medium, when data communication is enabled.

Alternatively, the communication medium performs data communication using the Internet.

BRIEF DESCRIPTION OF THE DRAWINGS

FIG. 13 is a diagram showing example information on the amounts of ink required for printing the sample images;

FIG. 14 is a diagram showing one example of the amounts of ink remaining in the printer at a certain time;

FIG. 15 is a diagram showing example information on the sample images;

FIG. 16 is an illustration showing one example of the number of sheets of the sample images can be printed with the amounts of ink remaining;

FIG. 21 is a diagram showing one example of the amounts of ink remaining in the printer for each detection date;

FIG. 22 is a diagram showing one example of the used-up dates of the inks;

FIG. 25 is a diagram showing example information on the amount of the ink required for printing the sample images;

FIG. 26 is a diagram showing one example of the amounts of ink remaining in the printer at a certain time;

FIG. 27 is a diagram showing example information on the sample images; and

FIG. 28 is an illustration showing one example of the number of sheets of the sample images that can be printed with the amounts of ink remaining in the printer.

DESCRIPTION OF THE PREFERRED EMBODIMENTS

The preferred embodiments of the present invention are described with reference to the attached drawings.

Since the following embodiments are preferred embodiments of the present invention, although technically preferable restrictions are applied to the present invention, the scope of the present invention is not limited to these embodiments unless otherwise specified.

First Embodiment

Figure 1:
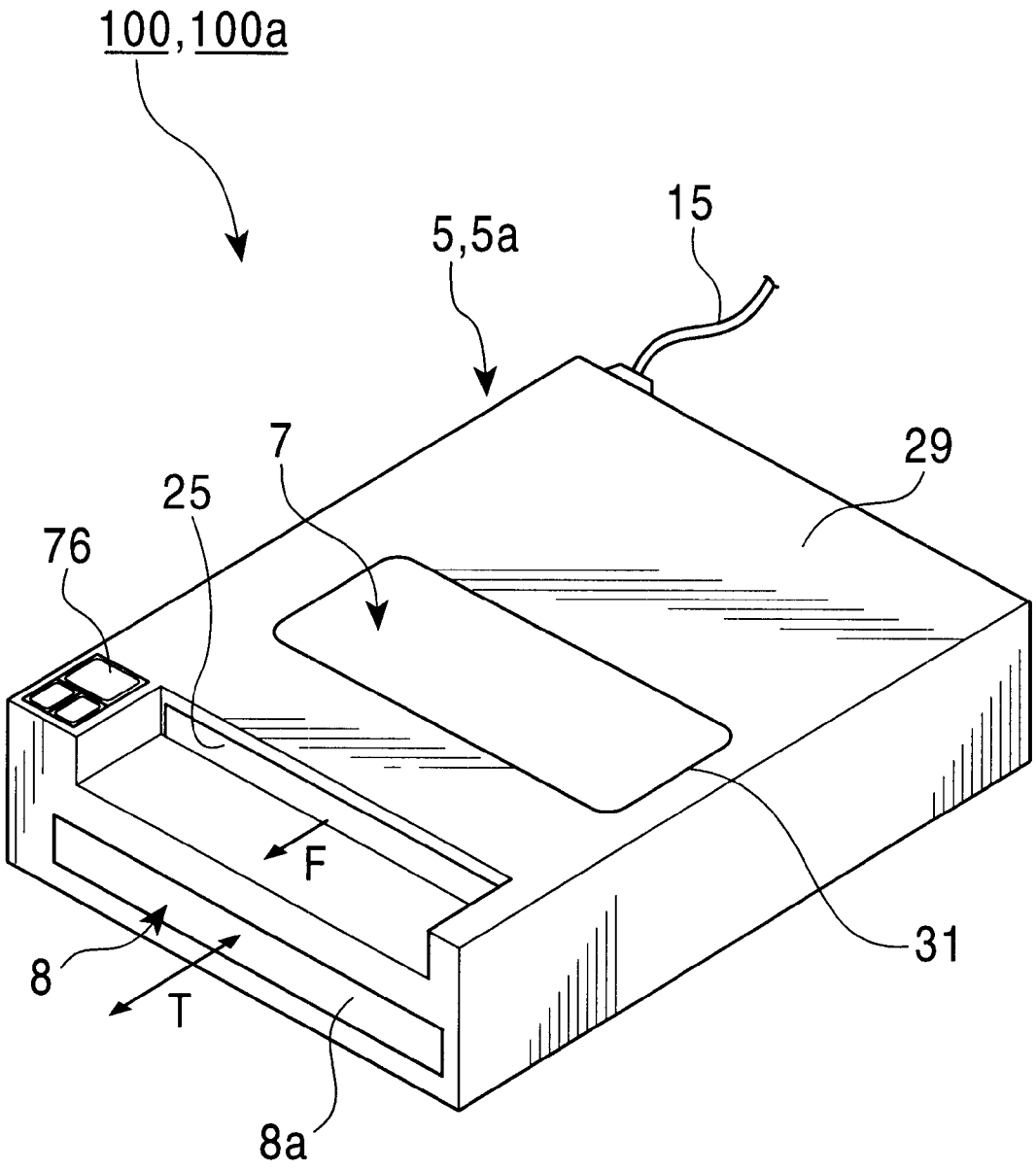
FIG. 1 is a perspective view showing an example appearance of a printer having a self-diagnosis system according to a first embodiment of the present invention.

FIG. 1 is a perspective view showing one example of the appearance of a printer 5 having a self-diagnosis system 100 (self-diagnosis device) according to a first embodiment of the present invention for achieving the foregoing first object of the present invention.

The printer 5 is a printing device that prints on record sheets by means of, for example, an inkjet method and has a built-in head assembly 7 for discharging ink. The printer 5 includes, as an outer covering, a substantially rectangular parallelepiped casing 29 having a partial cutaway. A head-assembly insertion/ejection opening 31 for inserting and ejecting the head assembly 7 and a display unit 76 are provided on the top face of the casing 29. A tray insertion/ejection opening 8*a* for inserting or ejecting a tray 8 accommodating record sheets (not shown) is provided in the front face of the casing 29 and an outlet 25 for outputting record sheets is provided in the cutaway of the casing 29. A cable, which serves as a power line or a signal line, is provided in the rear face of the casing 29.

Figure 2:
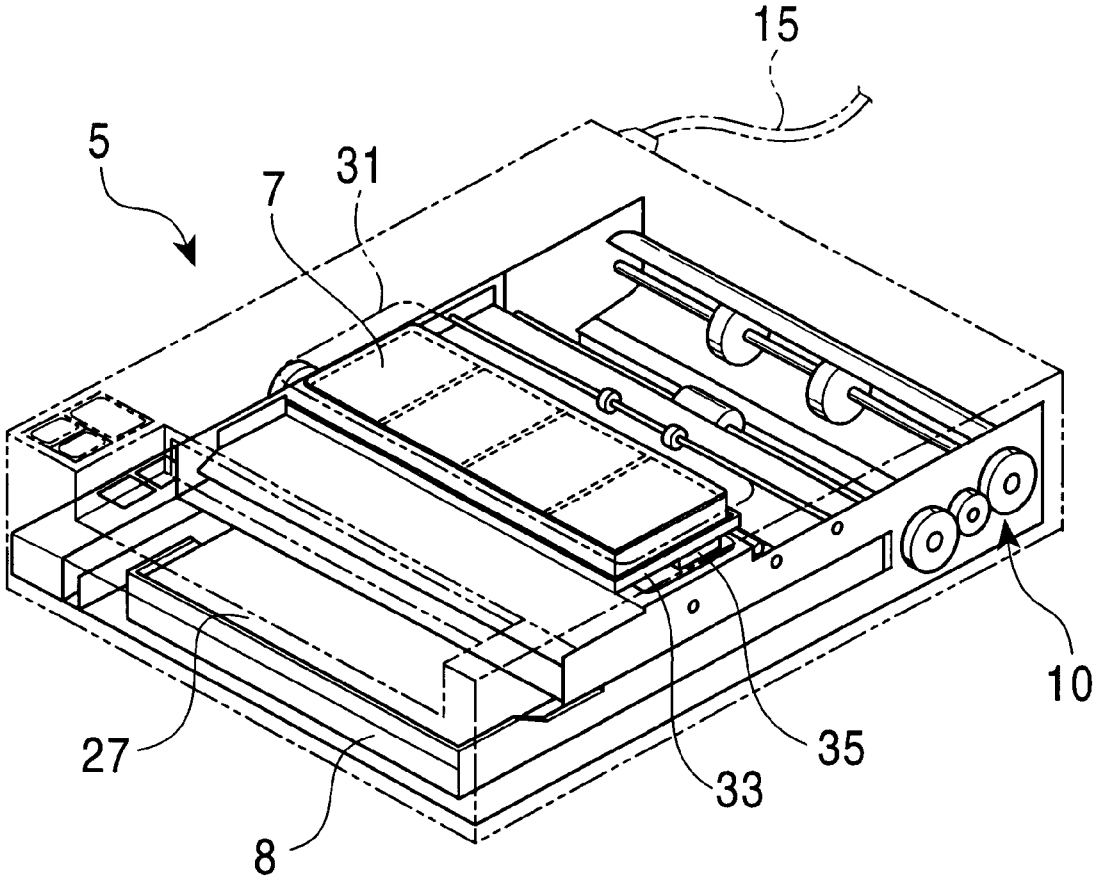
FIG. 2 is a perspective view showing an example construction of the printer in FIG. 1.
Figure 3:
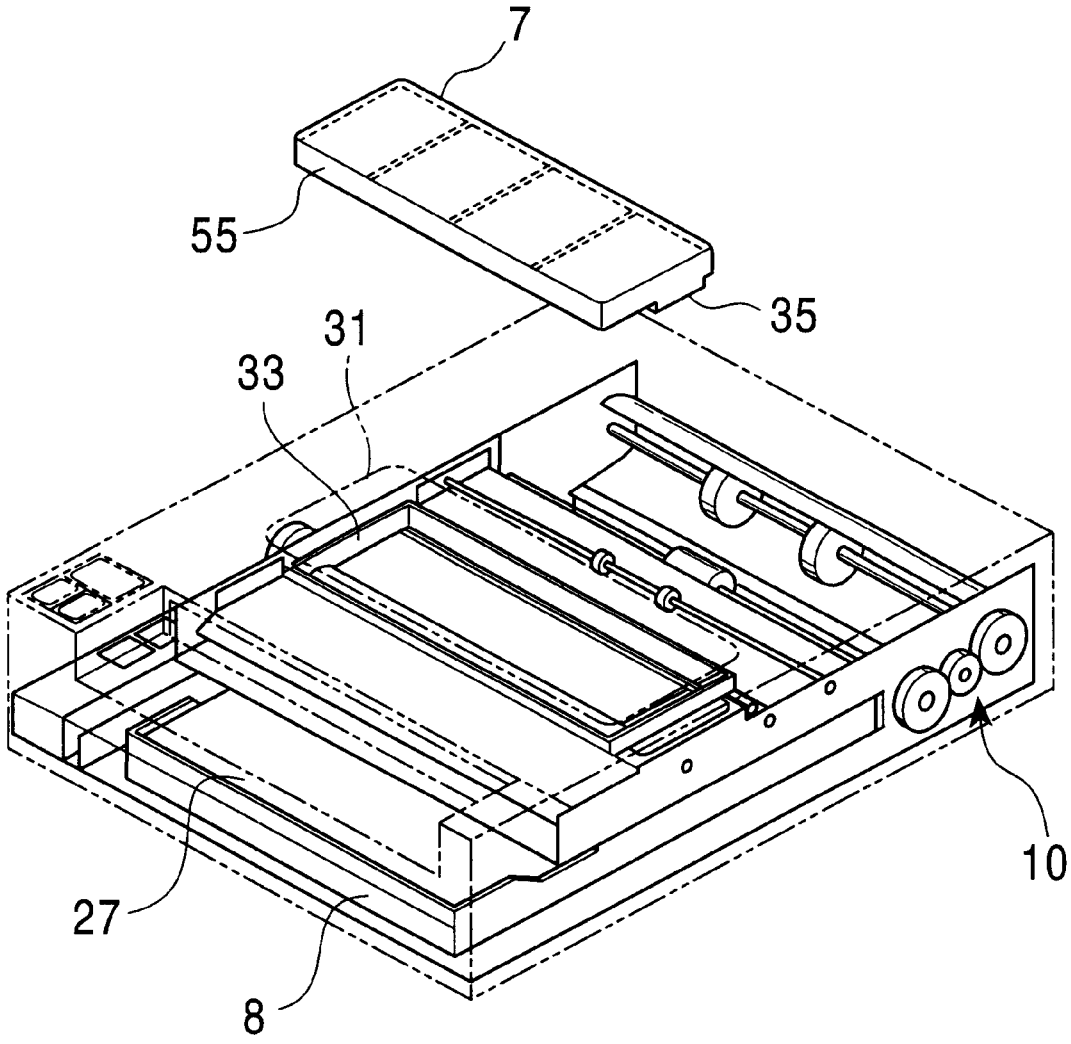
FIG. 3 is a perspective view showing one example of the appearance of the printer in FIG. 2 from which the head assembly 7 is removed.

FIG. 2 is a perspective view showing an example construction of the printer 5 in FIG. 1; FIG. 3 is a perspective view showing one example of the appearance of the printer 5 in FIG. 5 from which the head assembly 7 is removed.

A holder 33 is provided for holding the head assembly 7 such that the head assembly 7 is detachable. When the head assembly 7 is attached, the holder 33 holds the head assembly 7 such that a discharging head 35 of the head assembly 7 for discharging ink faces downward. The discharging head 35 and a record sheet 27 fed from the tray 8 by a printer mechanism unit 10 face each other, with a gap therebetween. Under the control of a predetermined printer control unit, the discharging head 35 discharges ink onto the record sheet 27 to print predetermined characters or images. Here, the printer mechanism unit 10 represents the overall mechanical part of the printer 5.

For example, the printer mechanism unit 10 includes a feeder unit feeding the record sheet 27 from the tray 8, a paper advancing unit having a roller or the like for advancing the record sheet, an outlet unit for outputting the printed record sheet, and other mechanisms required for the operation of the printer 5.

Figure 4:
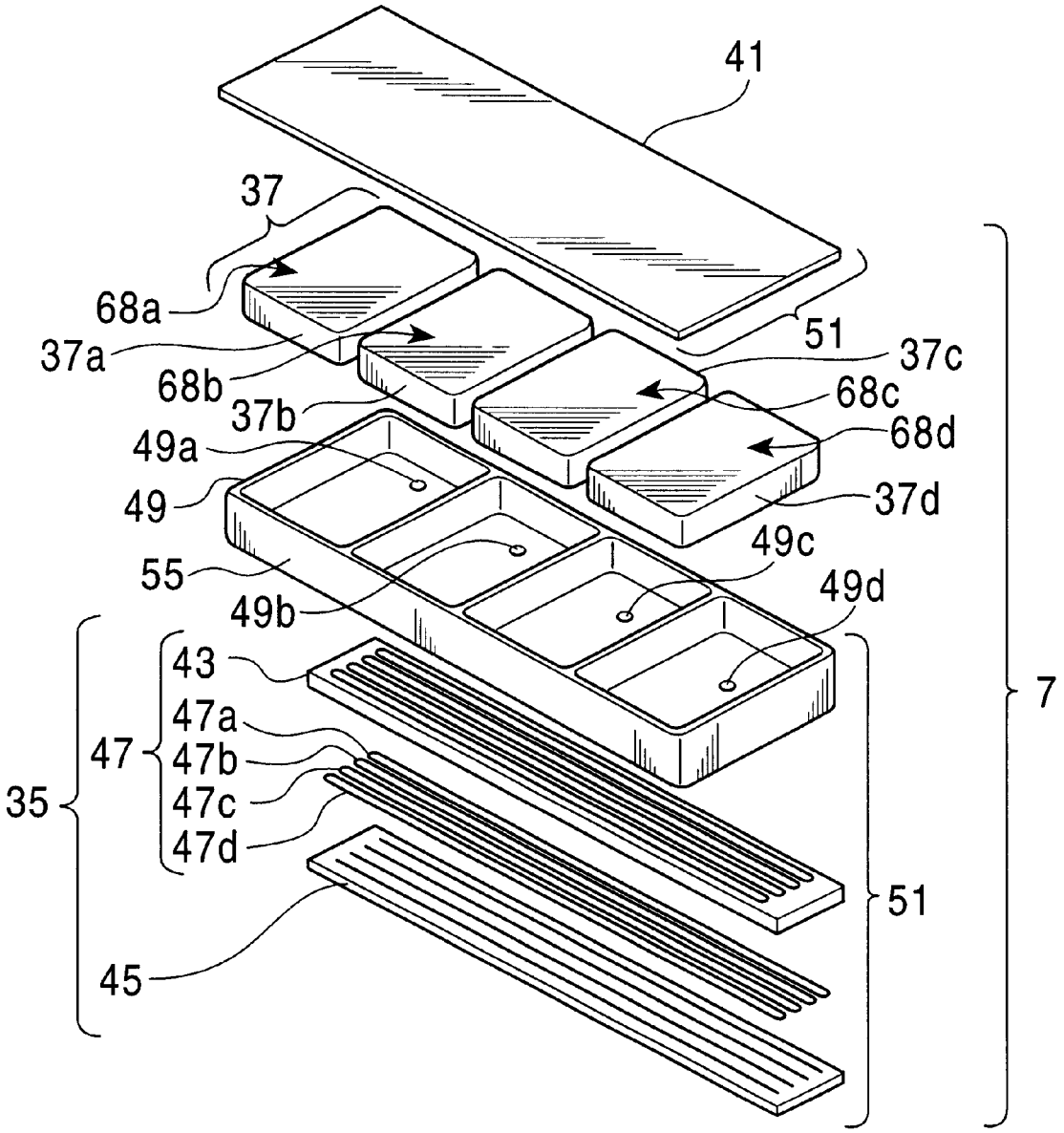
FIG. 4 is an exploded perspective view showing an example construction of the head assembly in FIG. 3.

FIG. 4 is an exploded perspective view showing an example construction of the head assembly 7 in FIG. 3.

The head assembly 7 primarily includes a head cartridge 51 and an ink cartridge 37.

The ink cartridge 37 includes an ink tank containing an ink of at least one color.

Specifically the ink cartridge 37 includes, for example, four colored ink tanks, a yellow ink tank 37*a*, a magenta ink tank 37*b*, a cyan ink tank 37*c*, and a black ink tank 37*d*. These ink tanks 37*a* to 37*d* each include ink supply/storage units (not shown) for supplying and storing the corresponding inks that are disposed on the faces thereof facing an ink cartridge holder 49.

The present invention is characterized in that residual-ink detecting devices 68*a* to 68*d* (diagnosing means, self-diagnosing device) for detecting the amounts of the corresponding colored inks remaining in the corresponding ink tanks 37*a* to 37*d* are provided. The residual-ink detecting devices 68*a* to 68*d* are described below.

The head cartridge 51 includes a cover 41, an ink cartridge holder 49, and the discharging head 35. This discharging head 35 includes a frame 43, a head chip 47, and a plate 45. The head chip 47 consists of a first head chip 47*a* to fourth head chip 47*d*.

The ink cartridge holder 49 is a member in which concave parts, the number of concave parts corresponding to the number of the ink tanks 37*a* to 37*d*, are formed so as to be able to hold the corresponding ink tanks 37*a* to 37*d* in a detachable manner. Holes 49*a* to 49*d* for disposing the ink supply/storage units for the ink tanks 37*a* to 37*d*, respectively, are provided at the bottom of the corresponding bottoms of these concave parts. When the ink tanks 37*a* to 37*d* are provided in the corresponding concave parts of the ink cartridge holder 49, the cover 41 is mounted so as to cover the top faces of the ink tanks 37*a* to 37*d*. This means that the ink tanks 37*a* to 37*d* are each sealed.

The first head chip 47*a* to fourth head chip 47*d* each discharge the four colored inks. These first head chips 47*a* to 47*d* are strip members. They are held between the plate 45 and the frame 43 so as to be disposed parallel to one another in the longitudinal direction thereof. The frame 43 is a flat member and is provided with long narrow slot-like holes which substantially correspond to the shapes of the first head chip 47*a* to the fourth head chip 47*d*. The frame 43 is mounted on the bottom face of the ink cartridge holder 49. The plate 45 is a flat member in which substantially straight-line nozzle holes are formed so as to correspond to the shapes of the first head chip 47*a* to the fourth head chip 47*d* to be sandwiched.

Figure 5:
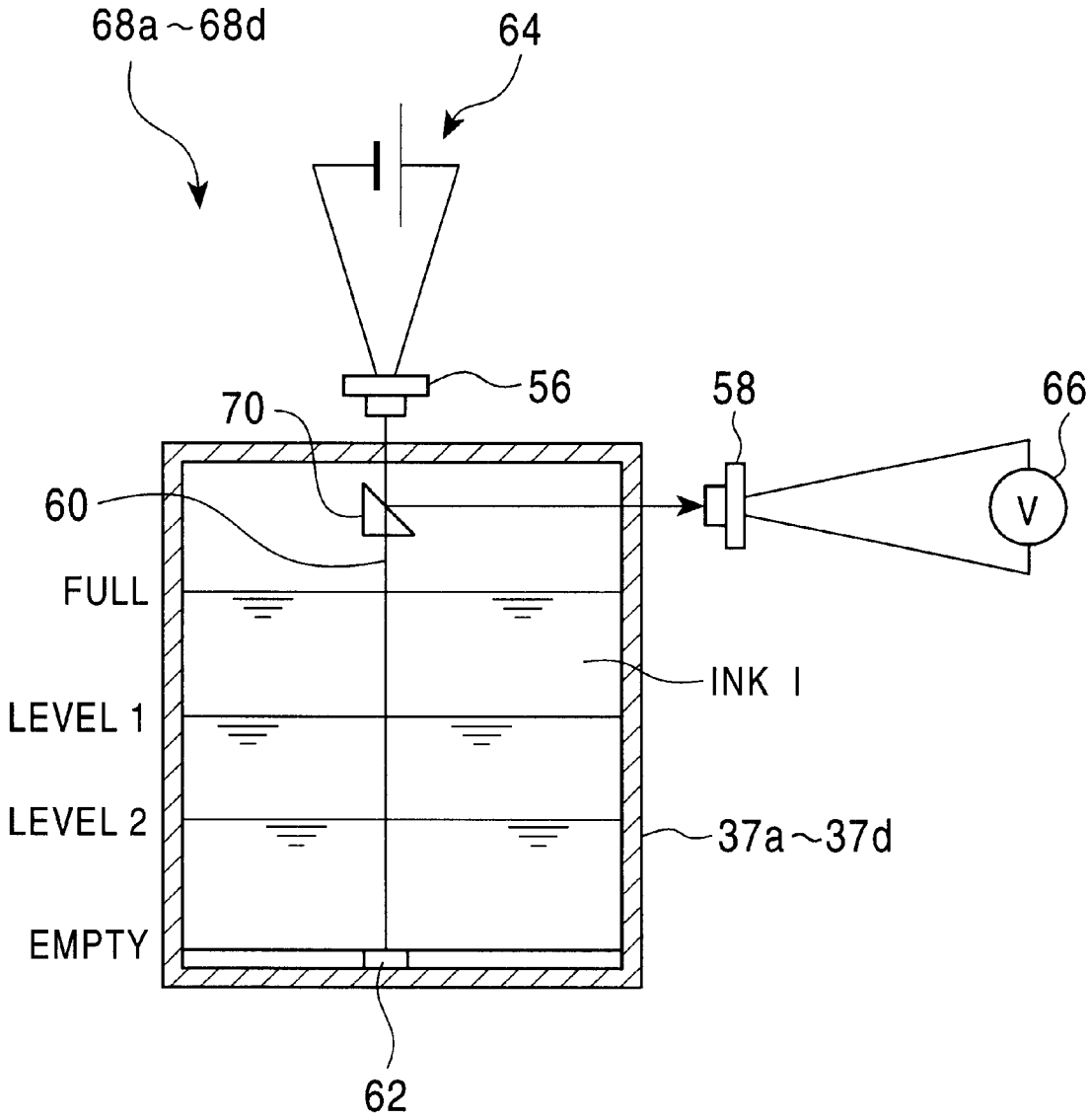
FIG. 5 is a cross sectional view showing an example construction of an ink-residual finding device in FIG. 4.

FIG. 5 is a cross-sectional view showing an example construction of the residual-ink detecting devices 68*a* to 68*d* in FIG. 4.

Since the residual-ink detecting devices 68*a* to 68*d* each have the same construction, only the residual-ink detecting device 68*a* is described. The residual-ink detecting device 68*a* includes an applying unit 64, a photodiode 56, a prism 70, a reflecting unit 62, a photo detector 58, and a measuring unit 66.

The applying unit 64 consists of a power source, for applying a predetermined voltage to the photodiode 56, and its control unit. The photodiode 56 irradiates a light 60 onto an ink I via the prism 70 when a predetermined voltage is applied to the photodiode 56. The prism 70 causes the light 60 to be transmitted from the photodiode 56 as well as causes the light 60 reflected from the reflecting unit 62 to be conducted to the photo detector 58. The photo detector 58 receives the light 60 transmitting through the ink I and outputs a predetermined voltage in accordance with the amount of the light 60 received. The measuring unit 66 measures the output from the photo detector 58. In FIG. 5, a hole and a member which includes a material allowing the light 60 to be transmitted are provided in a part in which the light 60 passes through the ink cartridge 37*a* and the like.

When the amount of the ink remaining is great, the attenuation of the light 60 is great, and vice versa. Therefore, in order to detect the amount of the ink remaining, the residual-ink detecting device 68*a* measures the variation in the output voltage from the photo detector 58, which depends on whether the amount of the light 60 is small or large.

Figure 6:
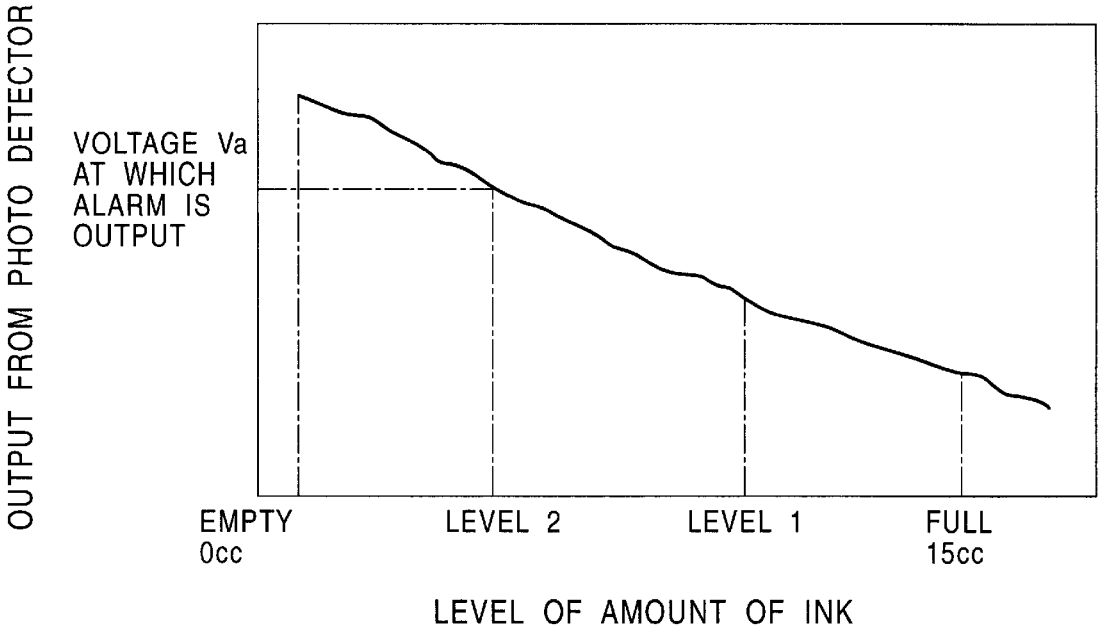
FIG. 6 is a diagram showing an example output from a photo detector when the level of the amount of the ink is detected by the ink-residual finding device in FIG. 5.

FIG. 6 shows one example of the output from the photo detector 58 versus the level of the amount of the ink detected by the residual-ink detecting device 68*a* in FIG. 5.

In FIG. 6, the level of the amount of the ink in the ink cartridge 37*a* is divided into a plurality of levels, for example, four levels; "Empty (e.g. 0 cc)" (the amount of ink I remaining is zero); "Level 2" (the amount of the ink I remaining is relatively small); "Level 1" (the amount of the ink I remaining is relatively large); and "Full (e.g. 15 cc)" (the amount of the ink I remaining is full). When the amount of the ink I remaining decreases, the level of the amount of the ink is changed from "Full" to "Level 1" and the output from the photo detector 58 in FIG. 5 gradually increases. This change exhibits a substantially identical characteristic in accordance with the decrease in the level of the amount of the ink remaining. When the level of the remaining ink reaches, for example, "Level 2", the residual-ink detecting device 68*a* determines that an alarm notifying the user that the amount of the ink I remaining is small should be output. The amount of the ink I remaining at which this alarm should be output can be arbitrarily set according to the specifications of the printer 5.

Figure 7:
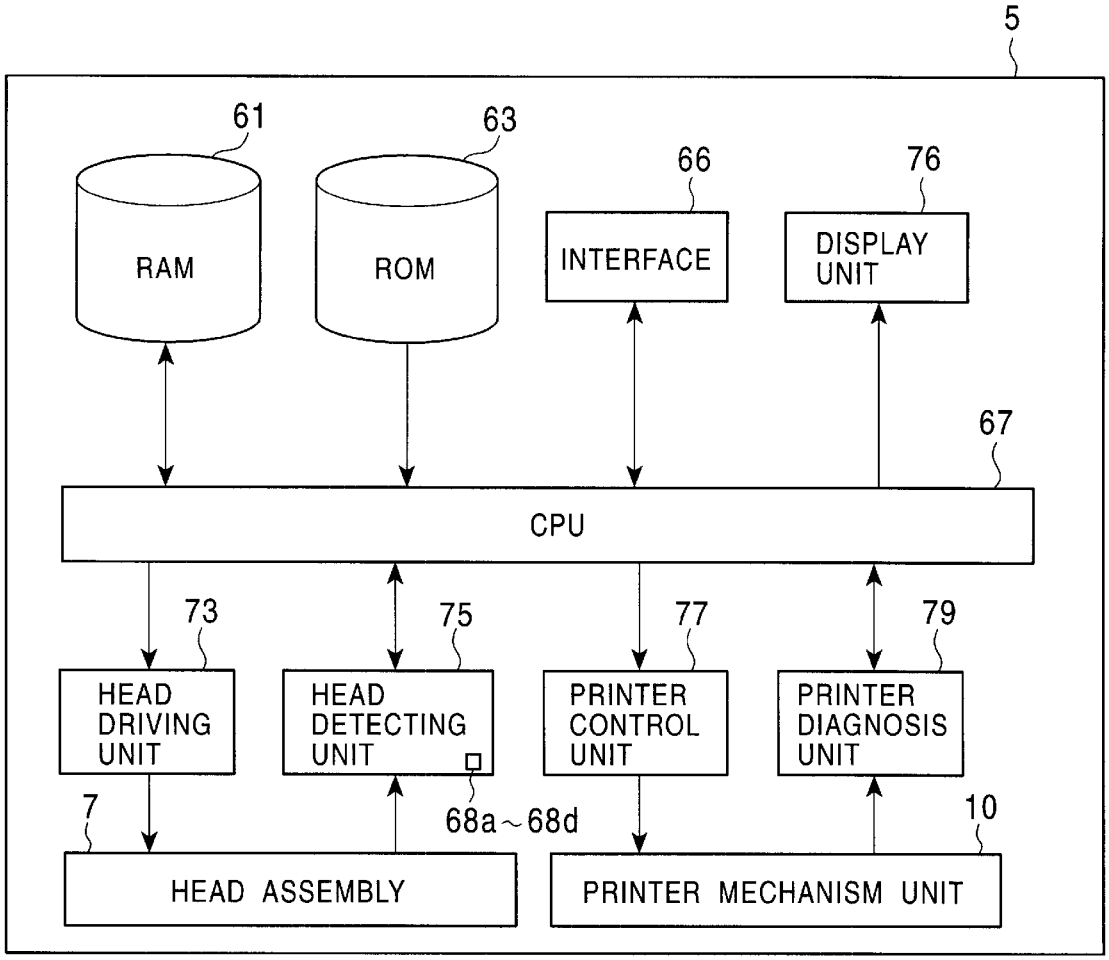
FIG. 7 is a block diagram showing an example electrical construction of the printer in FIG. 1.

FIG. 7 is a block diagram showing an example of an electrical construction of the printer 5 in FIG. 1.

The printer 5 includes a RAM (Random Access Memory) 61, a ROM (Read Only Memory) 63, a CPU (Central Processing Unit) 67, a head-driving unit 73, a head assembly 7, a head-detecting unit 75, a printer control unit 77, the printer mechanism unit 10, the display unit 76, and an interface 65. In addition, the printer 5 may include a printer diagnosis unit 79.

The RAM 61 is an information storage medium in which reading and writing can be performed, and it is a working area for the CPU 67. The ROM 63 is an information storage medium in which reading can be performed, and it supplies information stored therein to the CPU 67. In the ROM 63, the information may be changeable. The CPU 67 is connected to the RAM 61, the ROM 63, the head-driving unit 73, the head-detecting unit 75, the printer control unit 77, the printer diagnosis unit 79, the display unit 76, and the interface 65 which the CPU 67 controls and from which the CPU 67 obtains the data.

Under the control of the CPU 67, the head-driving unit 73 controls the operation of the head assembly 7. This head assembly 7 includes the ink cartridge and the head cartridge for discharging ink. The head-detecting unit 75 obtains predetermined information from the head assembly 7 which is detachable from the printer 5. For example, the head-detecting unit 75 detects that the head assembly 7 is attached to the printer 5.

Under the control of the CPU 67, the printer control unit 77 controls the operation of the printer mechanism unit 10. This printer mechanism unit 10 represents an overall mechanism for printing in the printer 5. The printer diagnosis unit 79 diagnoses the conditions of the printer mechanism unit 10.

Under the control of the CPU 67, the display unit 76 displays predetermined images and characters. The interface 66 is an interface for communicating data, such as images to be printed, for example, by having a printer cable using a Centronics interface connected thereto or by having a LAN (Local Area Network) cable using a network interface connected thereto.

The printer 5 is characterized in that the residual-ink detecting devices 68*a* to 68*d* are provided as parts of the head-detecting unit 75.

Figures 8, 9:
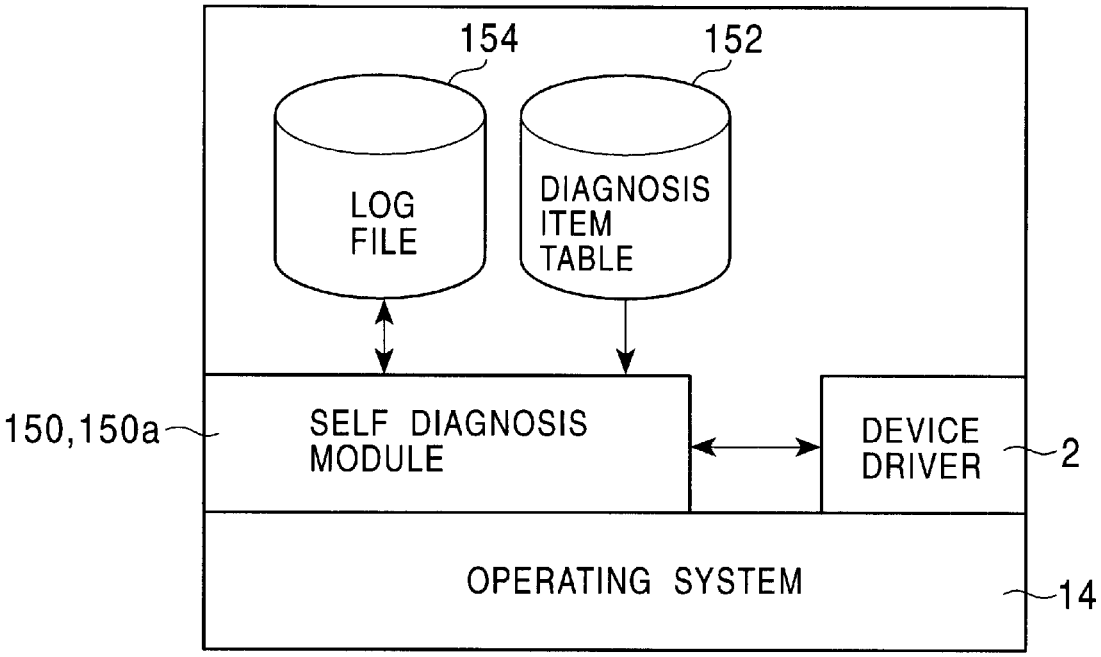
FIG. 8 is a software construction diagram showing an example construction of software running under the printer in FIG. 7.
FIG. 9 is a diagram showing one example of the amounts of ink remaining in the printer for each detection date.

FIG. 8 is a software construction diagram showing an example construction of software running under the printer 5 in FIG. 7.

In the printer 5, the CPU 67 executes software in which the RAM 61 serves as a working area. This software is, for example, a program having a self-diagnosis function of the printer 5. In the printer 5, for example, an operating system 14, a device driver 2, and a self-diagnosis module 150 (a program having the self-diagnosis function) are running.

The operating system 14 is so-called basic software, which controls software and the like running under the printer 5. The operating system 14 may be replaced by having other software execute the functions of the operating system 14. The device driver 2 controls the display unit 76, the head-driving unit 73, the printer control unit 77, and the like in FIG. 7 in order to manage each block connected to the CPU 67.

The self-diagnosis module 150 in FIG. 8 diagnoses the conditions of the printer 5 in FIG. 1 and, for example, detects the amounts of the inks remaining in the head assembly 7 of the printer 5. The self-diagnosis module 150 outputs an alarm when the amounts of the inks have decreased to predetermined amounts. Items that are used when the self-diagnosis module 150 diagnoses the conditions of the printer 5 are prestored in, for example, the ROM 63 in FIG. 7. When the ROM 63 is rewritable, the items may be variable.

As shown in FIG. 8, the self-diagnosis module 150 reads the diagnosis items stored in the diagnosis table 152 (diagnosing means) and directly controls the head-detecting unit 75 in FIG. 7 via the device driver 2 in accordance with the read diagnosis items. At the same time, the self-diagnosis module 150 may also control the printer diagnosis unit 79 in FIG. 7. The self-diagnosis module 150 obtains information on the amounts of the inks remaining from the residual-ink detecting devices 68*a* to 68*d* that are a part of the head-detecting unit 75. As shown in FIG. 8, when the self-diagnosis module 150 obtains the information on the amounts of the inks remaining, the information on the amounts of inks remaining is output to a log file 154. This log file 154 (diagnosing means) is created in the RAM 61 in FIG. 7.

Here, the information on the amounts of the inks remaining includes information on the colors of the inks (color information), information on date (detection date), and the amounts of the inks remaining.

The self-diagnosis module 150 computes the tendencies of the ways the residual inks decrease based on information on the amounts of the inks remaining, and estimates when the inks each run out based on the computed tendencies. That is, the self-diagnosis module 150 can understand the depletion trend of the amounts of the inks in accordance with the user's usage-pattern of the printer 5. The self-diagnosis module 150 can display information on the ink that runs out first among the residual inks. Detailed computation and the like performed by the self-diagnosis module 150 are described below.

The printer including the self-diagnosis system 100 has the above construction. A self-diagnosis method in the printer 5 is described with reference to FIGS. 1 to 8.

In short, the self-diagnosis system 100 informs a user of how many more days the printer 5 can print (operational-print period) with the amount of ink remaining when the user uses the printer 5 so as to maintain the current usage pattern.

Reading Operation (Diagnosis Step)

The amounts of the inks remaining and the like in the ink cartridge 7 in the printer 5 are detected for each color. To be specific, the CPU 61 in FIG. 7 causes the self-diagnosis module 150 to each instruct the residual-ink detecting devices 68*a* to 68*d*, which are a part of the head-detecting unit 75, to read the amounts of the corresponding inks remaining. As described above in FIG. 5, when the residual-ink detecting devices 68*a* to 68*d* receive the amount of remaining ink reading instruction by controlling the device driver 2 in FIG. 8, the residual-ink detecting devices 68*a* to 68*d* read the corresponding outputs from the photo detectors 58 for each colored ink. The self-diagnosis module 150 computes the amounts of the colored inks remaining based on the residual-ink level characteristics with respect to the output from the photo detector 58 shown in FIG. 6. The self-diagnosis module 150 writes the color information and the detection date onto the log file 154 as well as indicates the amounts of the inks remaining shown in FIG. 9.

When printing is completed, the self-diagnosis module 150 writes the color information, the detection date, and the amounts of the inks remaining onto the log file 154 as a residual-ink history (log). The log file 154 may be stored on a hard disk (not shown in FIG. 7). As a result of this, as shown in FIG. 9, the tendencies in which the amounts of the remaining inks decrease with respect to the passage of time are stored.

Operation Action

In response to a user's request or at an arbitrary time, the self-diagnosis module 150 receives an instruction to compute the time at which the level of the amount of the ink remaining becomes, for example, "Empty" (hereinafter, referred to as "used-up date of ink"). The self-diagnosis module 150 in FIG. 8 performs the following computation for each of the colored inks based on the residual ink history already stored in the log file 154.

Figures 10, 11:
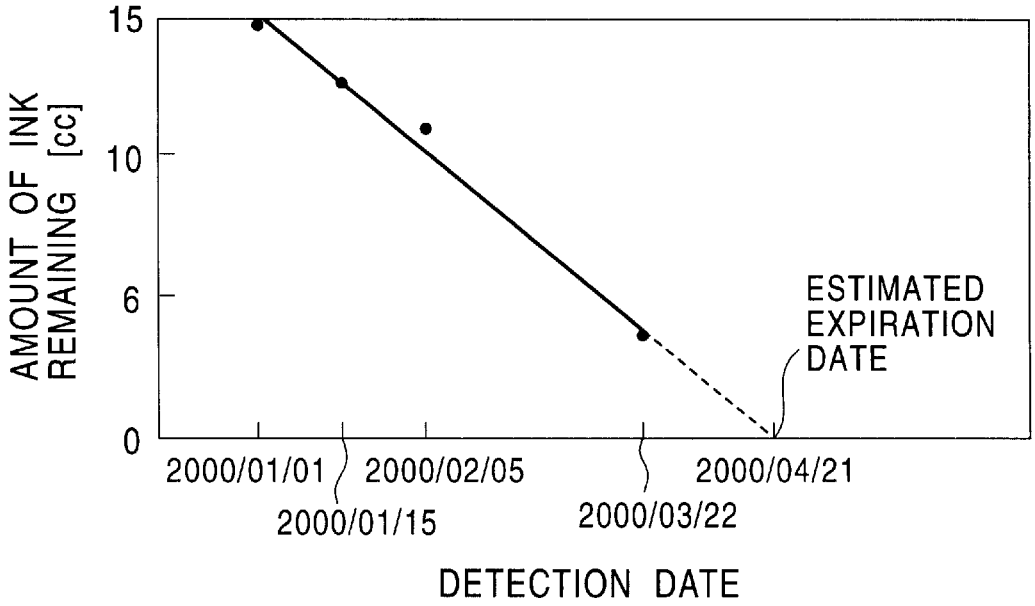
FIG. 10 is a diagram showing one example of the used-up dates of the ink.
FIG. 11 is a graph showing example information on the amount of ink required for printing a sample image.

The cyan was taken as the example color of the ink. The self-diagnosis module 150 detected the amount C of the ink remaining at the detection date (2000/01/01/11:21) stored in FIG. 9 as 15 cc. This is plotted as shown in FIG. 11. Thereafter, as shown in FIG. 9, the self-diagnosis module 150 detected the amounts C of the ink remaining as 13 cc, 11 cc, and 4 cc at the corresponding times, and these points are plotted as shown in FIG. 11. In FIG. 9, the amounts of remaining yellow ink, magenta ink, and black ink are represented as Y, M, and B, respectively.

The self-diagnosis module 150 computes the amount of the remaining ink="a" (the detection date+"b" by means of, for example, a least-square method ("a" is a constant and "b" is the amount of the filled-up ink) and detects, for example, the detection date (the above-mentioned used-up date of the ink) when the amount of the ink remaining is zero. This detection date is the "estimated date at which the ink will be used up" shown in FIG. 11. As shown in FIG. 10, the self-diagnosis module 150 writes the used-up date of each colored ink onto a predetermined file.

The self-diagnosis module 150 writes the used-up date of the ink at which the first colored ink will be used up of the ink (2000/4/21) among the used-up dates of the colored inks to "total determination" item shown in FIG. 10. The self-diagnosis module 150 writes the date when this determination is made to "determination date (detection date)" item. This enables information on when the self-diagnosis module 150 in FIG. 8 determines the amount of the ink remaining to be stored.

Display Step

Figure 12:
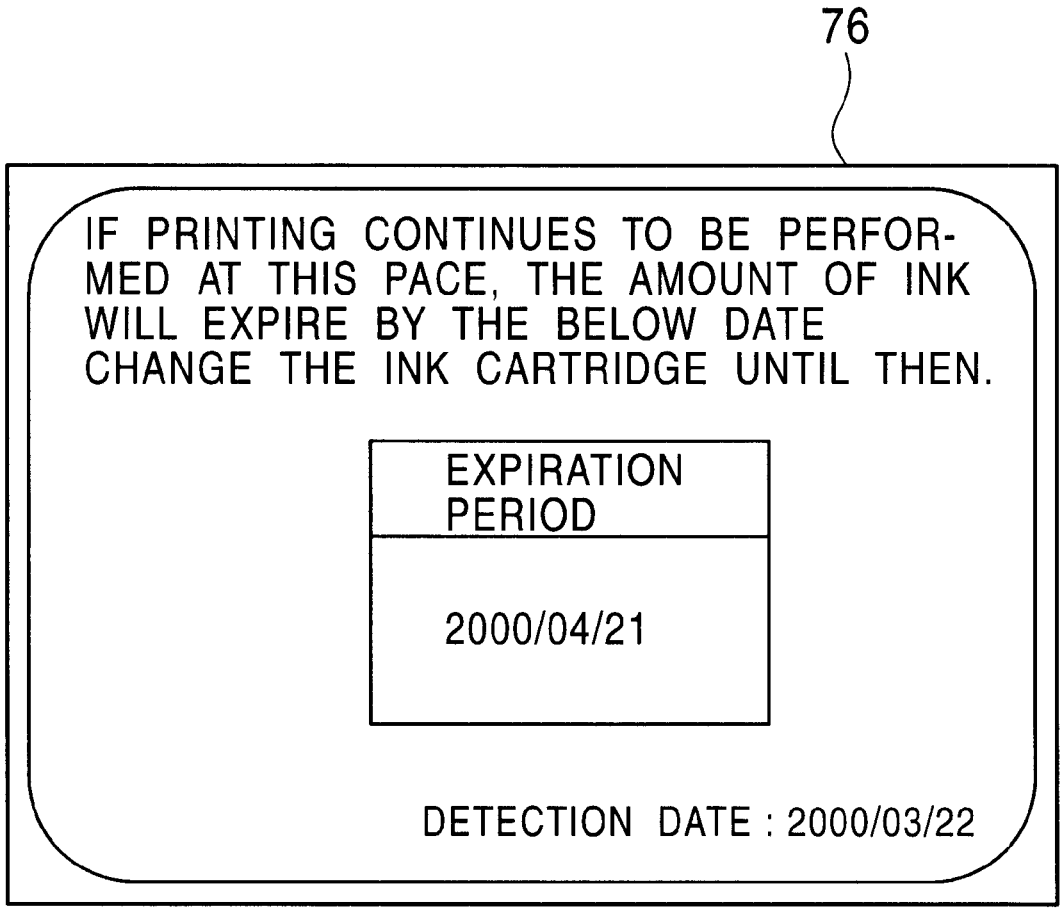
FIG. 12 is an illustration showing an example display on a display unit.

The diagnosis module 173 causes the display unit 76 in FIG. 1 to display the used-up date of the ink and the determination date, as shown in FIG. 12. The printer 5 may output an alarm to a user. This enables the user to visually recognize the used-up date of the ink in the printer 5. Accordingly, a situation wherein a printer runs out of ink can be prevented.

According to the first embodiment, if the user maintains the past printing pace, since information on the length of time (operational-print period) the printer can continue to print at the current printing pace is conveyed to the user, the user can accurately determine, based on his or her schedule, when to refill with a spare ink or when to change the ink. The use of the self-diagnosis module 150 in the printer 5 can avoid a situation in which the ink runs out suddenly because the user did not find out specifically until when the spare ink should have been provided. Therefore, the printer 5 can print at any time.

Second Embodiment

The second embodiment of the present invention for achieving the foregoing first object is described below.

Since the constructions of a self-diagnosis system 100*a* (self-diagnosis device) according to a second embodiment and a printer 5*a* using the same, respectively, are substantially identical to those of the self-diagnosis device according to the first embodiment and the printer 5 using the same in FIGS. 1 to 9, reference numerals in FIGS. 1 to 9 are assigned to the counterparts of the self-diagnosis system 100*a* and the printer 5*a*. Those that the second embodiment differs from the first embodiment are primarily described.

In order to inform a user of the amount of the ink remaining in the printer 5*a,* the self-diagnosis system 100*a* informs the user specifically how many more sheets of a predetermined sample image can be printed while the self-diagnosis system 100 informs the user of when the amount of the ink remaining in the printer 5 reaches a predetermined amount. Accordingly, in the self-diagnosis system 100*a,* the functions of the self-diagnosis module 150*a* (diagnosing means), of the log file 154 (diagnosing means), and of the diagnosis table 152 (diagnosing means) are slightly different from those of the counterparts in the self-diagnosis system 100.

FIG. 13 shows example information on the amounts of the inks remaining and the like required for printing the above sample images.

Information on the amounts of the inks required for printing the sample image (hereinafter, referred to as "sample image information") is stored in the diagnosis item table 152 in FIG. 8. Other than that, the print size and the image type are stored in the diagnosis item table 152 for each of the sample images. Y0, M0, C0, and B0 are the amounts of the required yellow ink, magenta ink, cyan ink, and black ink, respectively. The data stored in this diagnosis item table 152 may be stored in the CPU 67 of the printer 5 or the self-diagnosis module 150.

The self-diagnosis module 150*a* obtains the amounts Y, M, C, and B of the remaining yellow ink, magenta ink, cyan ink, and black ink, respectively, by the detecting method described in the first embodiment or by obtaining information from the log file 154 as shown in FIG. 8. The self-diagnosis module 150*a* obtains the quotients of the amounts of the colored inks Y/Y0, M/M0, C/C0, and B/B0 by dividing the amounts Y, M, C, and B of the remaining corresponding colored inks by the amounts Y0, M0, C0, and B0, respectively, of the corresponding colored inks required for printing predetermined sample images having predetermined print sizes shown in FIG. 13. The self-diagnosis module 150*a* performs integer processing such as [Y/Y0], [M/M0], [C/C0], and [B/B0]. The self-diagnosis module 150*a* obtains the smallest number among the computed integers as the number of sheets of a predetermined sample image having a predetermined size can be printed, which are information shown in the table in FIG. 15. Alternatively, the self-diagnosis module 150*a* writes it to the log file 154 in FIG. 8. Finally, as shown in FIG. 16, the self-diagnosis module 150*a* displays the sample names of the sample images, the operational-print sheet numbers, and the detection date on the display unit 76 in FIG. 1.

According to the second embodiment, substantially the same advantages as obtained in the first embodiment can be obtained. In addition, when a predetermined sample image is printed, since specific information such as how many more sheets can be printed (operational-print sheet number), a user can avoid such a situation wherein there is a sudden shortage of the ink in the printer 5. Accordingly, since the user can find out when to refill with a spare ink or change the ink, the printer 5*a* can always print.

The present invention is not limited to the foregoing embodiments.

Although the printers 5 and 5*a* each use the inkjet method in the above embodiments, the above embodiments may be applied to the printers that use other image-forming methods, such as a laser method or an LED method that employs electro-photography. That is, the above embodiments can be applied to the printers wherein ink is used up during printing. In the printer using the electro-photography, toner corresponds to the ink.

As a program storage medium for installing a program having a self-diagnosis function for executing the above described series of processes onto a computer or the printers 5 and 5*a* so as to allow the computer or the printers 5 and 5*a* to be ready to execute this program, a package medium such as a floppy disk, a CD-ROM (Compact Disc Read Only Memory), or a DVD (Digital Versatile Disc) may be used. Alternatively, the program storage medium may be realized using a semiconductor memory, a magnetic disk, or the like that stores the program temporarily or permanently. As a method to store the program in these storage media, a wire or wireless communication medium such as a local area network, the Internet, or a digital satellite broadcast may be used. In addition, various communication interfaces such as a router or a modem may be used to store the program in the medium. In addition, the printers 5 and 5*a* may be each provided with a drive device that can at least read information stored on the program storage media.

The function of the self-diagnosis systems 100 and 100*a* may be implemented using software or hardware.

The components of the foregoing embodiments may be partially omitted or they may be combined in a way different from the way those of the foregoing embodiments are combined.

Third Embodiment

The third embodiment of the present invention for achieving the foregoing second object is described.

Figure 17:
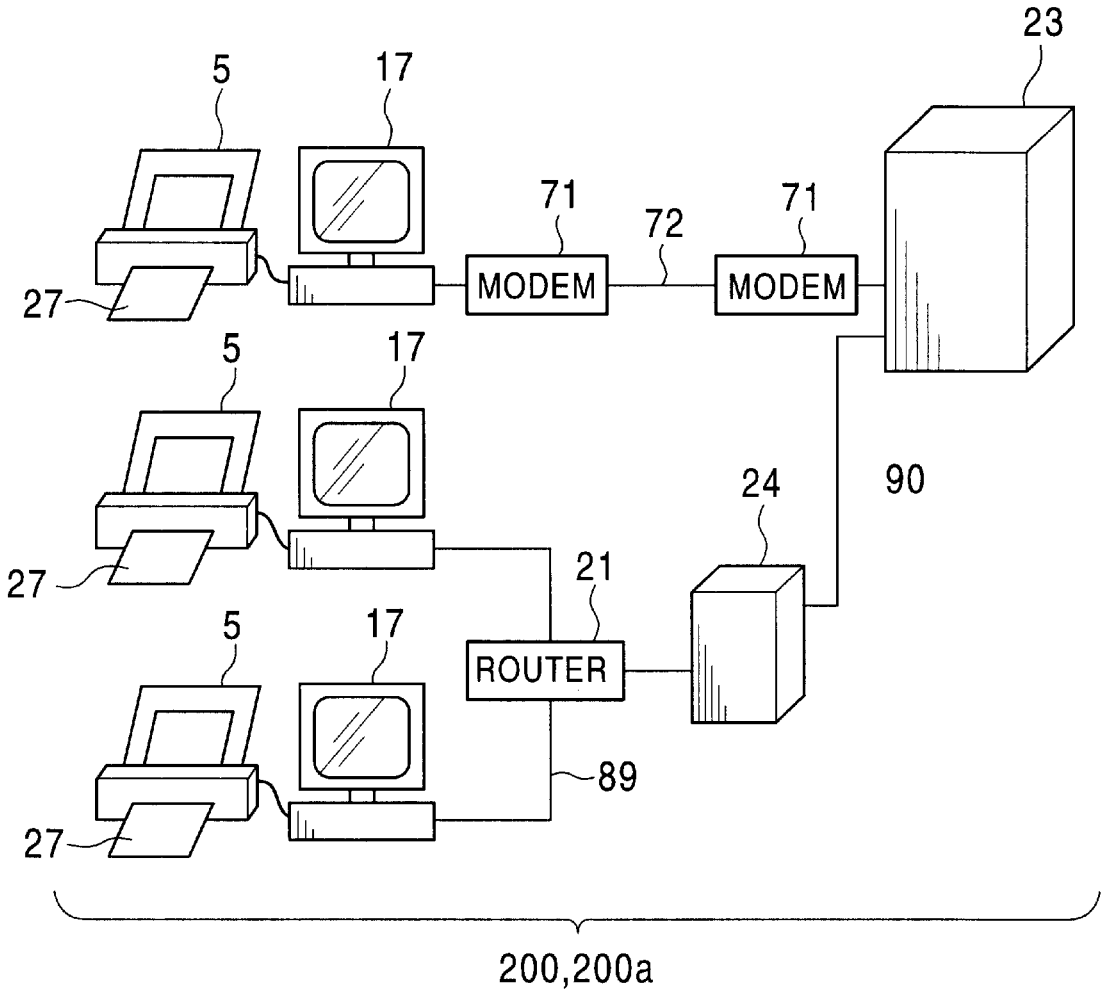
FIG. 17 is a block diagram showing one example construction of a remote-diagnosis system according to a third embodiment of the present invention.

FIG. 17 shows an example general construction of a remote-diagnosis system 200 according to the third embodiment. Since FIG. 17 is a block diagram showing the general construction of the remote-diagnosis system 200, the appearances of the printer 5 and the like are example.

The remote-diagnosis system 200 includes a service-center server 23, a computer 17, the printer 5, and a communication media for performing data communication between the service center server 23 and the computer 17. As the communication media provided for performing data communication between the service center server 23 and the computer 17, two modems 71 and a telephone line 72, or a network 89, a router 21, and a network 90 may be used. The latter case may include a server 24. In the following, an example is described in which the network 90 is the Internet.

When the network 90 is the Internet, the server 24 represents, for example, a server computer of an Internet service provider. Therefore, the remote-diagnosis system 200 can perform data communication between the service center server 4 and the computer 17.

The service center server 23 is a server computer provided in a service center that obtains and diagnoses the conditions of the printer 5 connected to the computer 17 via a printer cable or a network. The computer 17 is an example of electronic devices that request the printer 5 to print characters or images when they are to be printed. The printer 5 prints characters or images on the record sheet 27 in accordance with a request from the computer 17. The router 21 and the network 89 form a LAN (Local Area Network) that interconnects a plurality of computers 17.

Figure 18:
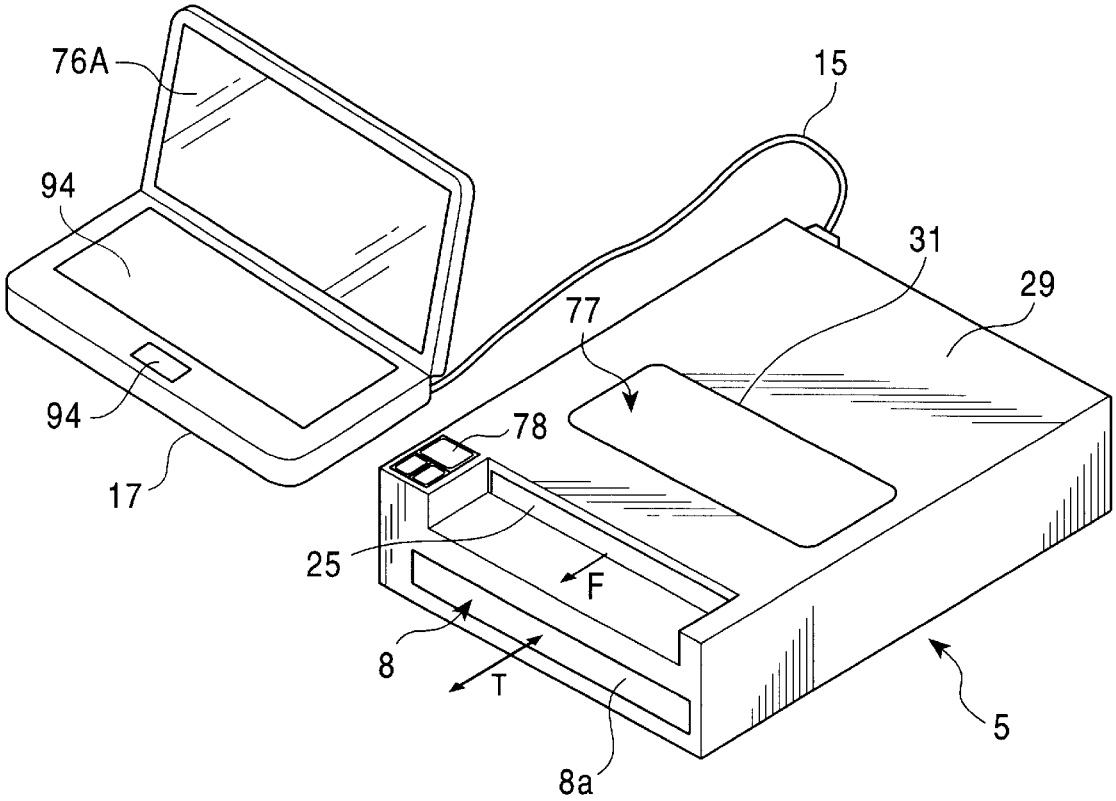
FIG. 18 is a perspective view showing the appearance of the printer having a remote-diagnosis system according to the third embodiment of the present invention.

FIG. 18 is a perspective view showing example appearances of the printer 5 and computer 17 in FIG. 17.

The computer 17 is, for example, a notebook-type or a desktop-type personal computer and connected to the printer 5 via a printer cable 15*a*. In appearance, the computer 17 includes at least a display unit 76*a* and an operation unit 94. The display unit 76*a,* which is, for example, a liquid crystal display, displays the diagnosis result obtained by, as described below, diagnosing the conditions of the printer 5. Alternatively, this diagnosis result may be displayed on not the display unit 76*a* of the computer 17 but the display unit 76 of the printer 5. The operation unit 94 includes a touch panel, a mouse, or a keyboard, and is operated by the user in order to operate the computer 17.

Since the printer 5 has the same construction as that of the printer according to the first embodiment, the descriptions of the common components are omitted.

In the third embodiment, the printer 5 and the head assembly 7 have the same constructions as those of the counterparts shown in FIGS. 1 to 4.

The residual-ink detecting devices according to the third embodiment have the same constructions as those of the residual-ink detecting devices 68*a* to 68*d* according to the first embodiment, which are described with reference to FIG. 5.

Therefore, the operations of the residual-ink detecting devices 68*a* to 68*d* according to the third embodiment are the same as those of the first embodiment and the output thereof are each the same as that of the example shown in FIG. 6.

The electrical construction of the printer 5 is identical to the counterpart according to the first embodiment, which is described with reference to FIG. 7.

Figure 19:
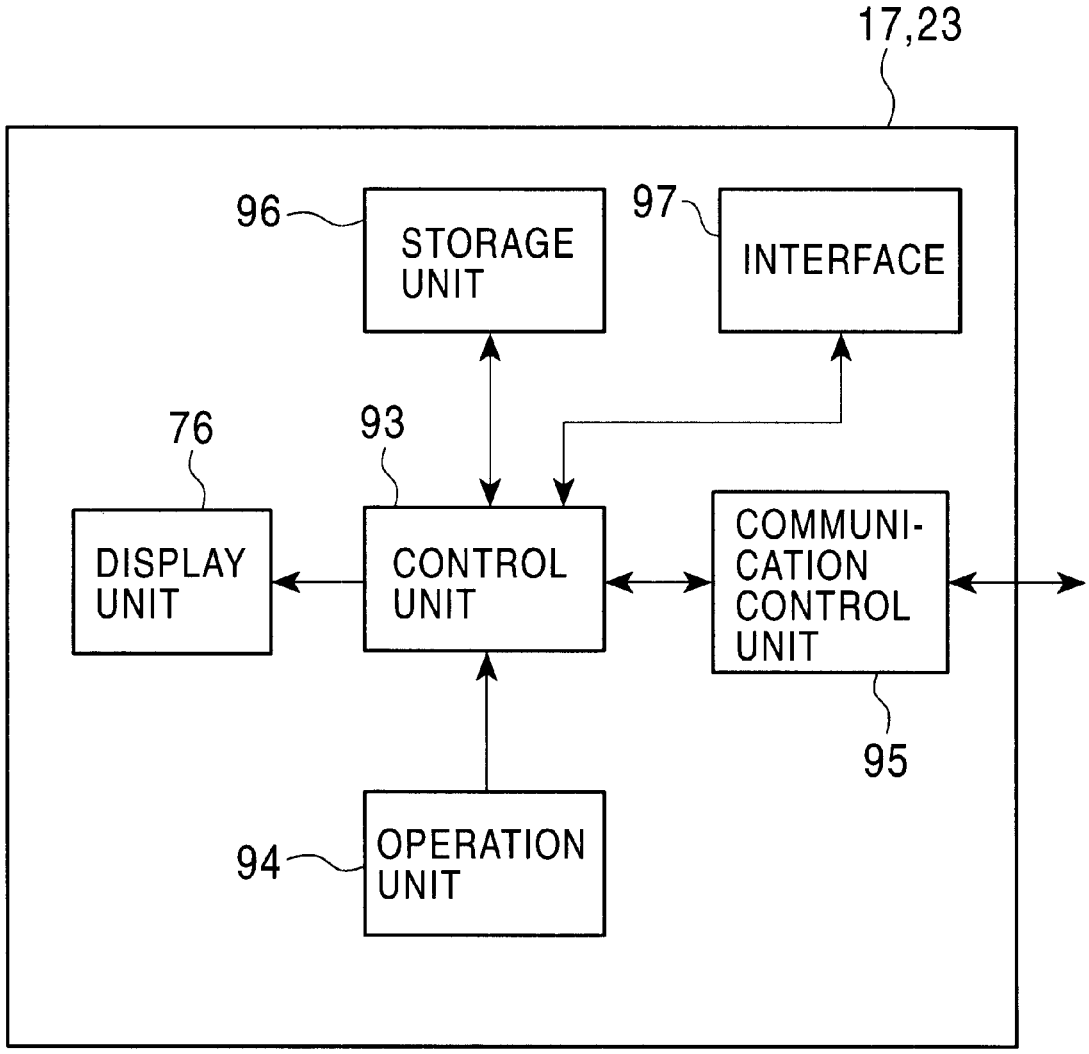
FIG. 19 is a hardware construction block diagram showing example electrical constructions of a service center server and a computer in FIG. 17.

FIG. 19 is a hardware construction diagram showing example electrical constructions of the service center server 23 and the computer 17 in FIG. 17

The service center server 23 and the computer 17 are similar in terms of the electrical construction, except at a point in which more processing power is required for the service center server 23 than the computer 17. Therefore, primarily the computer 17 is described, and those which the service center server 23 differs from the computer 17 are described if necessary.

The computer 17 includes a control unit 93, the display unit 76, a storage unit 96, an interface 97, a communication control unit 95, and the operation unit 94. The service center server 23 may include none of the display unit 76, the interface 97, and the operation unit 94.

The control unit 93, which is, for example, CPU (Central Processing Unit), is an arithmetic unit for controlling the entirety of the CPU 17. The storage unit 96 is writable/readable storage medium such as a RAM (Random Access Memory), a read-only storage medium such as a ROM (Read Only Memory), and a mass-storage medium such as a hard disk. The control unit 93 executes software or the like in which the RAM or the like of the storage unit 96 serves as a working area. The display unit 76 is controlled by the control unit 93, so that predetermined characters or images can be displayed. The interface 97 is a user interface such as a Centronics or a USB (Universal Serial Bus). The communication control unit 95 controls a network interface that performs data communication. As described above, the operation unit 94 is a user interface such as the keyboard.

Figure 20:
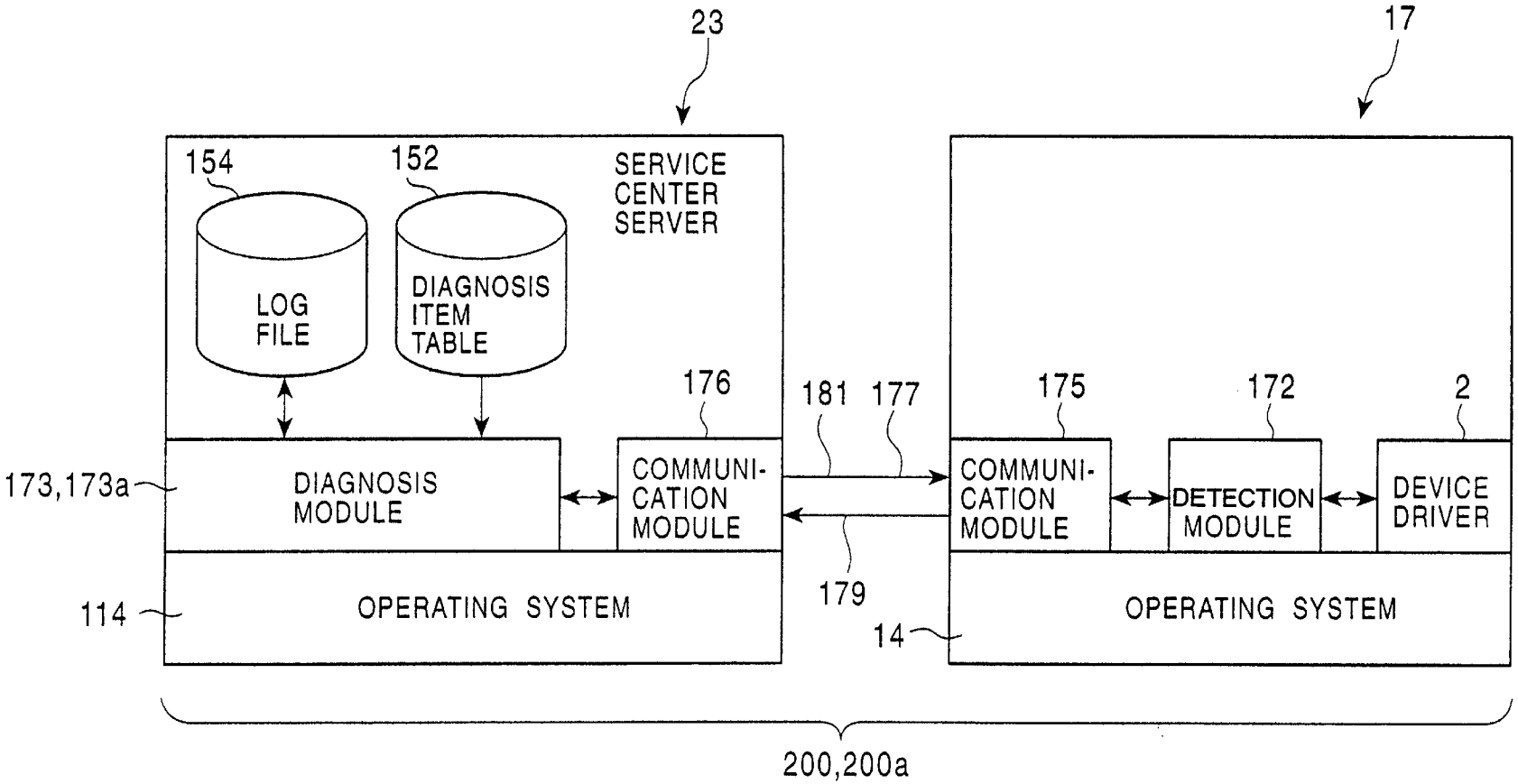
FIG. 20 is a software construction diagram showing a construction example of the remote-diagnosis system software in FIG. 17.

FIG. 20 is a software construction diagram showing an example software construction of the remote-diagnosis system 200 in FIG. 17.

Operating systems 114 and 14 run under the service center server 23 and the computer 17, respectively. The operating systems 14 and 114, which are basic software, control the operation of the software running under the printer 5. The operating systems 14 and 114 may be replaced by having other software execute the functions of the operating systems 14 and 114.

The service center server 23 includes the operating system 114, the diagnosis item table 152, the log file 154, the diagnosis module 173 (diagnosing means, a program having a remote diagnosis function), and a communication module 176 (diagnosing means, a program having a remote diagnosis function).

The diagnosis item table 152, which is the same as used in the first embodiment, holds information (e.g. information on the diagnosis of the amounts of the inks remaining, which is one of the conditions of the printer 5 and which is the same as in the first embodiment) on the items used for diagnosing the conditions of the printer 5. The log file 154 contains the result obtained by diagnosing the conditions of the printer 5 according to detection dates and is created in the RAM 61 in FIG. 7 in the same manner as in the first embodiment. As shown in FIG. 20, under the control of the diagnosis module 173, the communication module 176 performs data communication with the communication module 175 (diagnosing means, a program having a remote diagnosis function) of the computer 17. The diagnosis module 173 reads the diagnosis items stored in the diagnosis item table 152 and transmits a detection instruction 177 in accordance with the read diagnosis items to the computer 17. The detection instruction 177 is, for example, an instruction to the effect that the amounts of the inks remaining in the head assembly 7 should be obtained. This detection instruction 177 can be arbitrary set in accordance with the diagnosis items in the printer 5.

The communication module 176 receives a detection result 179 (the conditions of the printer 5) from the computer 17. This detection result 179 is information on the amounts of inks remaining.

The information on the amounts of the inks remaining contains at least information on the colors of the inks (color information), information on date (detection date), and information on the amounts of the inks remaining.

The diagnosis module 173 computes, based on information on the amounts of the above remaining inks, the tendencies in which the amounts of the remaining inks decrease, and estimates, based on the computed tendencies, when each of the inks runs out. The diagnosis module 173 can understand the tendencies of the decreases in the inks in accordance with the user's usage-pattern of the printer 5 in the same manner as in the first manner. The diagnosis module 173 can show information on the ink that runs out first among the inks. The detailed computation and the like performed by the diagnosis module 173 are described below.

The diagnosis module 173 controls the communication module 176 so that a diagnosis result 181 is output to the computer 17.

The computer 17 includes the operating system 14, the communication module 175 (a program having a remote-diagnosis function), and the detection module 172 (a program having a remote-diagnosis function), and the device driver 2.

In the same manner as in the first embodiment, the device driver 2 is software controlling the head-driving unit 73, the printer control unit 77, and the like in FIG. 7, and each managing the blocks which are connected to the CPU 67.

The detecting module 172 in FIG. 20 controls the device driver 2, instructs the residual-ink detecting devices 68*a* to 68*d* in FIG. 7 to detect the amounts of the remaining inks in the head assembly 7, and obtains the detection result 179. The items used by this detection module 172 for detecting the conditions of the printer 5 are prestored in, for example, the ROM 63 in FIG. 7. When the ROM 63 is rewritable, these items may be changeable. The communication module 175 transmits this detection result 179 to the service center server 23.

The printer 5 having the remote-diagnosis system 200 is constructed in the above-described manner and the remote diagnosis method thereof is described with reference to FIGS. 2 to 7 and FIGS. 17 to 20.

In short, the remote-diagnosis system 200 remotely informs the user of how many days the printer 5 can print when the user uses the printer 5 at the past printing pace (operational-print period).

Reading Instruction

In order to diagnose, the service center server 23 shown in FIG. 17 operates the diagnosis module 173 to receive the diagnosis item to the effect that the amounts of the remaining inks should be obtained from the diagnosis item table 152 and controls the communication module 176 so that the detection instruction 177 is transmitted to the computer 17. The computer 17 causes the communication module 175 to receive the detection instruction 177 and drives the detection module 172.

Reading Operation

The detection module 172 detects the amounts of the remaining inks in the ink cartridge 7 or the like in the printer 5. To be specific, under the control of the CPU 61 in FIG. 7, the detection module 172 controls the device driver 2 so that the amount of remaining ink reading instruction is sent to he corresponding residual-ink detection devices 68*a* to 68*d* which serve as a part of the head-detecting unit 75 in FIG. 7. When receiving the amount of remaining ink reading instruction, the residual-ink detecting devices 68*a* to 68*d* read the outputs from the photo detectors for the corresponding inks as already described with reference to FIG. 5. The communication module 175 transmits the detection result 179 detected by the detection module 172 to the service center server 23.

The service center server 23 causes the communication module 176 to receive the detection result 179 and send it to the diagnosis module 173. The diagnosis module 173 computes the amounts of the inks remaining based on the residual ink level characteristics with respect to the outputs from the corresponding photo detectors 58 shown in FIG. 6. The diagnosis module 173 writes the color information and the detection date along with the amounts of the inks remaining as shown in FIG. 21 to the log file 154.

Not only when the diagnosis module 173 in FIG. 20 sends the above detection instruction 177 to the computer 17, but also when the detection module 172 detects every predetermined period, the diagnosis module 173 may obtain the detection result 179. Thus, the diagnosis module 173 writes the color information, the detection date, and the amounts of the inks remaining as the residual ink history (log) to the log file 154. This log file 154 is stored in the RAM or the hard disk of the storage unit 96 in FIG. 19. As a result of this, as shown in FIG. 21, the log file 154 demonstrates the tendency in which the amounts of the remaining inks decrease over time.

Computation Operation

At the time of a request made from a user or at an arbitrary time, the diagnosis module 173 in FIG. 20 computes when the level of the amount of the ink remaining in FIG. 6 becomes "Empty" (hereinafter, referred to as "ink used-up date"). The diagnosis module 173 in FIG. 20 performs the following computation on each colored ink based on the residual ink history already stored in the log file 154.

Figure 23:
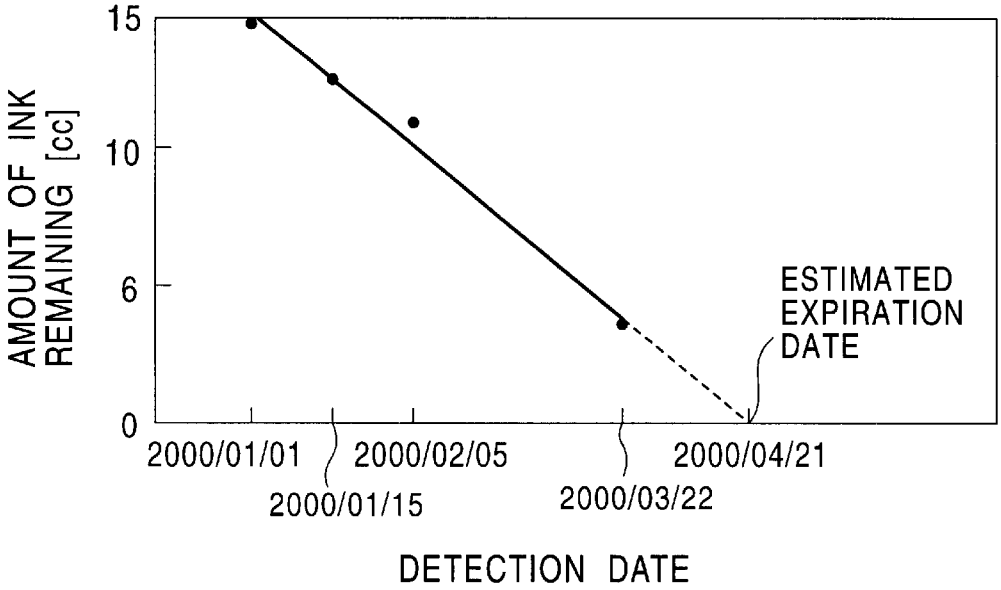
FIG. 23 is a graph showing example information on the amount of ink required for printing a sample image.

As an example of when the color of the ink is cyan, the diagnosis module 173 detects the amount C of the cyan ink remaining at the detection date (2000/01/01 11:21) stored in FIG. 21 as 15 cc and plots it as shown in FIG. 23. Thereafter, the diagnosis module 173 detects the corresponding amount C of the cyan ink remaining as 13 cc, 11 cc, and 4 cc at the each time shown in FIG. 23, and plots these. In FIG. 21, the amounts of the yellow ink remaining, the magenta ink, and the black ink represent Y, M, and B, respectively.

The diagnosis module 173 computes the amount of the ink remaining="a" (the detection date+"b", using, for example, the least-square method, in which "a" is a constant and "b" is the amount of the ink at which the ink is filled, whereby, for example, the diagnosis module 173 computes the detection date (i.e. the used-up date of the ink) when the amount of the ink remaining is zero. This detection date is "the estimated used-up date" as shown in FIG. 23. As shown in FIG. 22, the diagnosis module 173 writes the used-up date of each colored ink to a predetermined file.

The diagnosis module 173 writes the used-up date at which the first colored ink is used up (2000/04/21) from among the used-up dates of the inks to "the total determination" item. In addition, the diagnosis module 173 writes, to the "determination date (detection date)" item, the date when this determination is made. Thus, the diagnosis module 173 in FIG. 20 can store information on when the amounts of the inks remaining are determined.

The diagnosis module 173 controls the communication module 176 so that the diagnosis result 179 obtained in the above-described manner is transmitted to the computer 17. The computer 17 controls the communication module 175 so that the diagnosis result 179 is received.

Display Step

Figure 24:
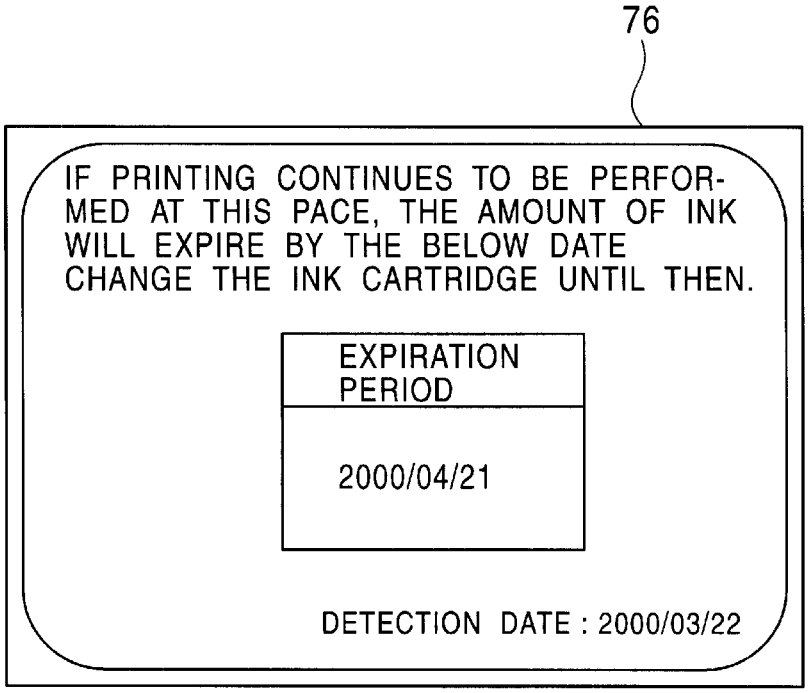
FIG. 24 is an illustration showing an example display on the display unit.

The diagnosis module 173 controls the device driver 2 so that, as shown in FIG. 24, the used-up date of the ink and the determination date are shown on the display unit 76 or the display unit 76*a*. Alternatively, at the same time, the computer 17 may alarm the user. Since this enables the user to see the used-up dates of the inks in the printer 5, the inks of the printer 5 can be prevented from running out.

According to the third embodiment of the present invention, since information (operational-print period) on how long the printer 5 can print when a user uses the printer 5 so as to maintain the past printing pace is remotely diagnosed and is informed to the user, the user can correctly determine when to refill with a spare ink or change the ink based on his or her schedule to use the printer 5. In addition, according to the diagnosis module 173 in the printer 5, the user can avoid such a situation wherein there is a sudden shortage of ink because the user can find out specifically until when the spare ink must be supplied. Accordingly, the printer 5 can always positively print.

A characteristic advantage in the third embodiment of the present invention is that the printer 5 needs only the minimum storage capacity required for printing because neither the printer 5 nor the computer 17 needs to hold the diagnosis result of the conditions of the printer 5. In addition, since the printer 5 does not have to self-diagnose the detected conditions thereof, the processing load is reduced. This enables the printer 5 to be inexpensive because the high processing power is not required for the printer 5.

According to the third embodiment of the present invention, since the service center server 23 obtains the detection result 181 from the printer 5, the service center server 23 can understand this detection result 181 and can correctly estimate the amounts of the inks which should be stocked and the like. When a service center having the service center server 23 sells various types of inks, since users' preferred inks and the like can be understood, marketing research can be easily performed.

Fourth Embodiment

Hereinafter, the fourth embodiment of the present invention for achieving the foregoing second object is described.

Since the constructions of a remote-diagnosis system 200*a* (remote-diagnosis device) according to the fourth embodiment and the printer 5*a* using the same, respectively, are substantially identical to those of the remote-diagnosis device 200 according to the third embodiment and the printer 5 (which is the same as described in the first embodiment) using the same in FIGS. 2 to 24, reference numerals in FIGS. 2 to 24 are assigned to the counterparts of the remote-diagnosis system 200*a* and the printer 5*a*. Those that the fourth embodiment differs from the second embodiment are primarily described.

In order to inform a user of the amount of the ink remaining in the printer, the remote-diagnosis system 200*a* informs the user specifically how many more sheets of a predetermined sample image can be printed while the remote-diagnosis system 200 informs the user of when the amount of the ink remaining in the printer 5 reaches a predetermined amount. Accordingly, in the remote-diagnosis system 200*a,* the functions of the remote-diagnosis module 173*a* (diagnosis means), of the communication modules 176 and 175, of the log file 154, and of the diagnosis table 152 are slightly different from the functions of the counterparts in the self-diagnosis system 200.

FIG. 25 shows example information on the amounts of the inks remaining and the like required for printing the above sample images.

Information on the amounts of the inks required for printing the sample images (hereinafter, referred to as "sample image information") is stored in the diagnosis item table 152 in FIG. 20.

Other than that, the print size and the image type are stored in the diagnosis item table 152 for each of the sample images. Y0, M0, C0, and B0 are the amounts of the required yellow ink, magenta ink, cyan ink, and black ink, respectively. The data stored in this diagnosis item table 152 may be stored in the CPU 67 of the printer 5 or the diagnosis module 173*a*.

The diagnosis module 173*a* obtains the amounts Y, M, C, and B of the remaining yellow ink, magenta ink, cyan ink, and black ink, respectively, by the detecting method described in the third embodiment or by obtaining information from the log file 154 as shown in FIG. 26. The remote-diagnosis module 173*a* obtains the quotients of the amounts of the colored inks Y/Y0, M/M0, C/C0, and B/B0 by dividing the amounts Y, M, C, and B of the remaining corresponding colored inks by the amounts Y0, M0, C0, and B0, respectively, of the corresponding colored inks required for printing predetermined sample images having predetermined print sizes. The diagnosis module 173*a* performs integer processing such as [Y/Y0], [M/M0], [C/C0], and [B/B0].

The diagnosis module 173*a* obtains the smallest number among the computed integers as the number of sheets of a predetermined sample image having a predetermined size can be printed, which are information shown in the table in FIG. 27. Alternatively, the diagnosis module 173*a* writes it to the log file 154 in FIG. 20. Finally, as shown in FIG. 28, the diagnosis module 173*a* displays the sample names of the sample images, the operational-print sheet numbers, and the detection date on the display unit 76*a* or 76 in FIG. 18.

According to the fourth embodiment, substantially the same advantages as obtained in the third embodiment can be obtained. In addition, when a predetermined sample image is printed, since specific information such as how many more sheets can be printed (operational-print sheet number), a user can avoid such a situation wherein there is a sudden shortage of the ink in the printer 5. Accordingly, since the user can find out when to refill with a spare ink or change the ink, the printer 5*a* can always print.

The present invention is not limited to the foregoing embodiments.

In the foregoing embodiments, the amounts of the inks remaining in the printers 5 and 5*a* are each diagnosed. In addition, other items in the printers 5 and 5*a* may be each diagnosed.

Although the printers 5 and 5*a* each use the inkjet method in the above embodiments, the above embodiments may be applied to the printers that use another image-forming method, such as the laser method or the LED method that employs electro-photography. That is, the above embodiments can be applied to the printers wherein ink or toner is used up during printing.

In the above embodiments, the printers 5 and 5*a* may include storage means such as memory for storing at least a part of the detected conditions thereof and transmitting means for transmitting at least a part of the conditions of thereof when data communication is enabled via a communication medium such as the network 90. Since this eliminates the necessity of transmission of the detected conditions to the service center server 23 at one time, the size of data on the conditions of the printers 5 and 5*a* transmitted at one time can be decreased.

As a program storage medium for installing a program having a remote-diagnosis function for executing the above-described series of processes onto a computer so as to allow the computer to be ready to execute this program, a package medium such as a floppy disk, the CD-ROM, or the DVD may be used. Alternatively, the program storage medium may be realized using a semiconductor memory, a magnetic disk, or the like that stores the program temporarily or permanently. As a method to store the program in these storage media, a wire or wireless communication medium such as the local area network, the Internet, or the digital satellite broadcast may be used. In addition, various communication interfaces such as the router or the modem may be used to store the program in the medium. In addition, the service center server 4, the printers 5, and 5*a* may be each provided with the drive device that can at least read information stored on the program storage media.

In the remote-diagnosis systems 200 and 200*a,* by providing the functions of the computer 17 in the printers 5 and 5*a,* the computer 17 may be omitted.

The components of the foregoing embodiments may be partially omitted or they may be combined in a way different from the way those of the foregoing embodiments are combined.

What is claimed is:

1. A self-diagnosis device for determining the number of sheets of at least one type of print sample which can be printed using a remaining amount of at least one type of ink in a printer, said device comprising:

a reference table for storing information indicating an amount of ink required for printing a predetermined number of sheets of the print sample;

an ink detecting device for detecting the amount of ink remaining in the printer;

diagnosing means for calculating the number sheets of the print sample which can be printed using the remaining amount of ink in the printer, based on the amount of ink remaining in the printer detected by the ink detecting device and the information stored in the reference table; and displaying means for the calculation result of the diagnosing means.

2. The self-diagnosis device as defined in claim 1 wherein, the self-diagnosis device determines the number of sheets which can be printed for a plurality of types of print samples;

the reference table indicates the amount of ink required for printing each of the plurality of print samples; and the diagnosing means calculates the number of sheets which can be printed for each type of print samples based on the amount of remaining ink detected by the ink detecting device and the amount of ink required for printing each type of print samples indicated in the reference table;

wherein the displaying means displays the number of sheets calculated for each type of print samples.

3. The self-diagnosis device as defined in claim 2 wherein, the printer holds a plurality of types of ink;

the reference table stores information indicating the amount of ink required for printing each of the plurality of print samples for each of the plurality of types of ink;

the ink detecting device detects the amount of ink remaining in the printer of each type of ink; and the diagnosing means calculates the number of sheets which can be printed for each type of print samples using the remaining amount of ink of each type of ink in the printer;

wherein the displaying means displays the smallest number of sheets calculated using the remaining amount of each type of ink for a select print sample as the number of sheets which can be printed for the select print sample.

4. The device as defined in claim 1 wherein, said ink detecting device includes a photo detector for receiving light transmitted through the ink remaining in the printer and outputting a signal indicating the amount of ink remaining in the printer corresponding to the received light.

5. The method as defined in claim 4 wherein, the number of sheets which can be printed is determined for a plurality of types of print samples;

information indicating the amount of ink required for printing each of the plurality of print samples is stored in the reference table;

the number of sheets which can be printed for each type of print samples is calculated based on the detected amount of ink remaining in the printer and the information indicating the amount of ink required for printing each type of print samples stored in the reference table; and the number of sheets calculated for each type of print samples is displayed.

6. The method as defined in claim 5 wherein, the number of sheets which can be printed for the plurality of types of print samples is determined using a remaining amount of a plurality of types of ink in the printer;

information indicating the amount of ink of each of the plurality of types of ink required for printing each of the plurality of print samples is stored in the reference table;

the amount of ink remaining in the printer of each type of ink is detected;

the number of sheets which can be printed for each type of print samples is calculated using the remaining amount ink of each type of ink in the printer; and the smallest number of sheets calculated using the remaining amount of each type of ink for a select print sample is displayed as the number of sheets which can be printed for the select print sample.

7. A method for determining the number of sheets of at least one type of print sample which can be printed using a remaining amount of at least one type of ink in a printer, said method comprising the steps of:

storing information indicating an amount of ink required for printing the print sample in a reference table;

detecting the amount of ink remaining in the printer;

calculating the number of sheets of the print sample which can be printed using the amount of ink remaining in the printer, based on the detected amount of ink in the printer and the information stored in the reference table; and displaying the calculation result.

8. A system for remotely determining the number of record sheets which can be printed using a remaining amount of at least one type of ink in a printer for at least one type of print sample, said system comprising:

control means for controlling a print operation of the printer;

an ink detecting device provided on the printer and in communication with the control means for detecting the amount of ink remaining in the printer;

storing means for storing information indicating a predetermined amount of ink required for printing a predetermined number of sheets of the print sample;

diagnosing means in remote communication with the control means for calculating the number of sheets of the print sample which can be printed using the remaining amount of ink in the printer, based on the amount of ink remaining in the printer detected by the ink detecting device and the information retrieved from the storing means; and displaying means for displaying the calculation result of the diagnosing means.

9. The system as defined in claim 8 wherein, the system determines the number of sheets which can be printed for a plurality of types of print samples;

the storing means stores information indicating the amount of ink required for printing each of the plurality of print samples; and the diagnosing means calculates the number of sheets which can be printed for each type of print samples based on the remaining amount of ink detected by the ink detecting device and the information stored in the reference table;

wherein the displaying means displays the number of sheets calculated for each type of the print samples.

10. The system as defined in claim 9 wherein, the system determines the number of sheets which can be printed using a remaining amount of a plurality of types of ink in the printer for a plurality of types of print samples;

the reference table indicates the amount of each of the plurality of types of ink required for printing each type of the plurality of print samples;

the ink detecting device detects the amount of ink remaining in the printer of each type of ink; and the diagnosing means calculates the number of sheets which can be printed for each type of print samples using the remaining amount of each type of ink in the printer;

wherein the displaying means displays the smallest number of sheets calculated using the remaining amount of each type of ink for a select print sample as the number of sheets which can be printed for the select print sample.

11. The system as defined in claim 8 wherein said ink detecting device includes a photo detector for receiving light transmitted through the ink remaining in the printer and outputting a signal indicating the amount of ink remaining in the printer corresponding to the received light.

12. The system as defined in claim 8 wherein the storing means is provided on the printer, and the information stored in the storing means is remotely communicated to the diagnosing means.

13. The system as defined in claim 8 wherein the diagnosing means and the control means communicate via the Internet.

14. A method for remotely determining the number of record sheets which can be printed from a remaining amount of at least one type of ink in a printer for at least one type of print sample, said method comprising the steps of:

storing information indicating a predetermined amount of ink required for printing a predetermined number of sheets of the print sample in storing means;

detecting the amount of ink remaining in the printer using an ink detecting device provided on the printer, and communicating the detected amount to control means for controlling a print operation of the printer;

calculating the number of sheets of the print sample which can be printed using the remaining amount of ink in the printer, based on the amount of ink remaining in the printer remotely communicated from the control means and the information retrieved from the storing means; and displaying the calculation result.

15. The method as defined in claim 14 wherein, the number of sheets which can be printed is determined for a plurality of types of print samples;

information indicating the amount of ink required for printing each of the plurality of print samples is stored in the storing means;

the number of sheets which can be printed for each type of print samples is calculated based on the detected amount of remaining ink and the information indicating the amount of ink required for printing each type of print samples stored in the storing means; and the number of sheets calculated for each type of the print samples is displayed.

16. The method as defined in claim 15 wherein, the number of sheets which can be printed for the plurality of types of print samples is determined using a remaining amount of a plurality of types of ink in the printer;

information indicating the amount of ink of each of the plurality of types of ink required for printing each of the plurality of print samples is stored in the storing means;

the amount of ink remaining in the printer of each type of ink is detected;

the number of sheets which can be printed for each type of print samples is calculated using the remaining amount ink of each type of ink in the printer; and the smallest number of sheets calculated using the remaining amount of each type of ink for a select print sample is displayed as the number of sheets which can be printed for the select print sample.

17. The method as defined in claim 14 wherein the storing means is provided on the printer and the information stored on the storing means is remotely communicated to the diagnosing means.

18. The system as defined in claim 14 wherein the diagnosing means and the control means communicate via the Internet.

19. A computer-readable program storage medium storing a program having a remote-diagnosis function for remotely determining the number of record sheets which can be printed from a remaining amount of at least one type of ink in a printer for at least one type of print sample, said program comprising the steps of:

storing information indicating a predetermined amount of ink required for printing a predetermined number of sheets of the print sample in storing means;

detecting the amount of ink remaining in the printer using an ink detecting device provided on the printer, and communicating the detected amount to control means for controlling a print operation of the printer;

calculating the number of sheets of the print sample which can be printed using the remaining amount of ink in the printer, based on the amount of ink remaining in the printer remotely communicated from the control means and the information retrieved from the storing means; and displaying the calculation result.

20. The program as defined in claim 19 wherein, the number of sheets which can be printed is determined for a plurality of types of print samples;

information indicating the amount of ink required for printing each of the plurality of print samples is stored in the storing means;

the number of sheets which can be printed for each type of print samples is calculated based on the detected amount of remaining ink and the information indicating the amount of ink required for printing each type of print samples stored in the storing means; and the number of sheets calculated for each type of the print samples is displayed.

21. The program as defined in claim 20 wherein, the number of sheets which can be printed for the plurality of types of print samples is determined using a remaining amount of a plurality of types of ink in the printer;

information indicating the amount of ink of each of the plurality of types of ink required for printing each of the plurality of print samples is stored in the storing means;

the amount of ink remaining in the printer of each type of ink is detected;

the number of sheets which can be printed for each type of print samples is calculated using the remaining amount ink of each type of ink in the printer; and the smallest number of sheets calculated using the remaining amount of each type of ink for a select print sample is displayed as the number of sheets which can be printed for the select print sample.

* * * * *